US012291373B2

(12) United States Patent
Srichai

(10) Patent No.: US 12,291,373 B2
(45) Date of Patent: May 6, 2025

(54) COLLAPSIBLE CRATE

(71) Applicant: Goodpack IBC (Singapore) Pte Ltd, Singapore (SG)

(72) Inventor: Uthai Srichai, Bangkok (TH)

(73) Assignee: Goodpack IBC (Singapore) Pte. Ltd., Singapore (SG)

( * ) Notice: Subject to any disclaimer, the term of this patent is extended or adjusted under 35 U.S.C. 154(b) by 0 days.

(21) Appl. No.: 18/034,565

(22) PCT Filed: Nov. 1, 2021

(86) PCT No.: PCT/IB2021/000764
§ 371 (c)(1),
(2) Date: Apr. 28, 2023

(87) PCT Pub. No.: WO2022/096928
PCT Pub. Date: May 12, 2022

(65) Prior Publication Data

US 2023/0399142 A1 Dec. 14, 2023

Related U.S. Application Data

(60) Provisional application No. 63/109,098, filed on Nov. 3, 2020.

(51) Int. Cl.
*B65D 19/12* (2006.01)

(52) U.S. Cl.
CPC .... *B65D 19/12* (2013.01); *B65D 2519/00024* (2013.01); *B65D 2519/00273* (2013.01);
(Continued)

(58) Field of Classification Search
CPC ..... B65D 19/08; B65D 19/12; B65D 19/18; B65D 88/52; B65D 2519/00024;
(Continued)

(56) References Cited

U.S. PATENT DOCUMENTS 5,269,414 A 12/1993 D Hollander
6,347,718 B1 2/2002 Karpisek
(Continued)

FOREIGN PATENT DOCUMENTS

BR 112013000883 A2 5/2016
CL 200000636 U1 7/2001
(Continued)

OTHER PUBLICATIONS

European Patent Office, Communication Pursuant to Rule 164(1) EPC, Partial Supplementary European Search Report dated Oct. 31, 2022 for European Patent Application No. 20766176.0, 13 pages.
(Continued)

*Primary Examiner* — Bryon P Gehman
(74) *Attorney, Agent, or Firm* — Fitch, Even, Tabin & Flannery, LLP

(57) ABSTRACT

A collapsible crate is disclosed having a base and a plurality of walls. The base includes a top surface and defines a cavity below the top surface. The plurality of walls are removably attachable to one another and are movable between a first configuration where the plurality of walls extend substantially vertically above the top surface of the base and a second configuration where the plurality of walls are within the cavity of the base.

28 Claims, 31 Drawing Sheets

(52) U.S. Cl.
CPC ..... *B65D 2519/00288* (2013.01); *B65D 2519/00293* (2013.01); *B65D 2519/00298* (2013.01); *B65D 2519/00323* (2013.01); *B65D 2519/00333* (2013.01); *B65D 2519/00502* (2013.01); *B65D 2519/00512* (2013.01); *B65D 2519/00611* (2013.01); *B65D 2519/00656* (2013.01); *B65D 2519/00661* (2013.01); *B65D 2519/009* (2013.01); *B65D 2519/0096* (2013.01); *B65D 2519/00975* (2013.01)

(58) Field of Classification Search
CPC ..... B65D 2519/00273; B65D 2519/00288; B65D 2519/00293; B65D 2519/00298; B65D 2519/00323; B65D 2519/00333; B65D 2519/00502; B65D 2519/00512; B65D 2519/00611; B65D 2519/00656; B65D 2519/00661; B65D 2519/009; B65D 2519/0096; B65D 2519/00975
USPC ..... 220/4.28–4.34
See application file for complete search history.

(56) References Cited

U.S. PATENT DOCUMENTS

| | | | | |
|---|---|---|---|---|
| 7,066,332 | B2 * | 6/2006 | Kobayashi | B65D 7/28 220/6 |
| 7,216,592 | B2 | 5/2007 | Krech | |
| 7,281,637 | B2 * | 10/2007 | Hadar | B65D 19/18 220/4.28 |
| 7,350,662 | B2 | 4/2008 | Arnold | |
| 7,819,269 | B2 | 10/2010 | Perkins | |
| 8,228,201 | B2 | 7/2012 | Kennedy | |
| 9,802,754 | B2 * | 10/2017 | Navalon Simon | B65D 88/522 |
| RE47,210 | E | 1/2019 | Lam | |
| 10,577,174 | B2 | 3/2020 | Fenneman | |
| 11,021,320 | B2 | 6/2021 | Lv | |
| 2004/0026296 | A1 | 2/2004 | Nesting | |
| 2004/0059035 | A1 | 3/2004 | Krech | |
| 2004/0149766 | A1 | 8/2004 | Karpisek | |
| 2005/0000834 | A1 | 1/2005 | Clive-Smith | |
| 2005/0150892 | A1 | 7/2005 | Miller | |
| 2005/0178770 | A1 | 8/2005 | Hase | |
| 2005/0224494 | A1 | 10/2005 | Heinrichs | |
| 2005/0230283 | A1 | 10/2005 | Kobayashi | |
| 2006/0043090 | A1 | 3/2006 | Ferrini | |
| 2006/0104755 | A1 | 5/2006 | Clive-Smith | |
| 2006/0144838 | A1 | 7/2006 | Winn | |
| 2007/0278223 | A1 | 12/2007 | Ficker | |
| 2008/0011742 | A1 | 1/2008 | Bellehumeur | |
| 2009/0272739 | A1 | 11/2009 | Fredrickson | |
| 2010/0072199 | A1 | 3/2010 | Manuel | |
| 2010/0147842 | A1 | 6/2010 | Reynard | |
| 2012/0012492 | A1 | 1/2012 | Darden | |
| 2013/0112685 | A1 | 5/2013 | Lam | |
| 2014/0042157 | A1 | 2/2014 | Giesbers | |
| 2016/0251153 | A1 | 9/2016 | Navalón Simón | |
| 2020/0079582 | A1 | 3/2020 | Press et al. | |
| 2022/0144540 | A1 | 5/2022 | Argentti | |

FOREIGN PATENT DOCUMENTS

| | | | |
|---|---|---|---|
| CL | 2007003534 | U1 | 3/2009 |
| CN | 1589214 | A | 3/2005 |
| CN | 201172503 | Y | 12/2008 |
| CN | 201280262 | Y | 7/2009 |
| CN | 201281057 | Y | 7/2009 |
| CN | 101519146 | A | 9/2009 |
| CN | 201808724 | U | 4/2011 |
| CN | 201908924 | U | 7/2011 |
| CN | 103158924 | B | 6/2013 |
| CN | 203652327 | U | 6/2014 |
| CN | 105083698 | A | 11/2015 |
| CN | 102837874 | B | 8/2016 |
| CN | 107074400 | A | 8/2017 |
| CN | 108341124 | A | 7/2018 |
| CN | 207631661 | U | 7/2018 |
| CN | 108657560 | A | 10/2018 |
| CN | 208102617 | U | 11/2018 |
| CN | 109229718 | A | 1/2019 |
| CN | 208377317 | U | 1/2019 |
| CN | 208485096 | U | 2/2019 |
| CN | 208499327 | U | 2/2019 |
| CN | 109533561 | A | 3/2019 |
| CN | 110436014 | A | 11/2019 |
| CN | 209634890 | U | 11/2019 |
| CN | 110641849 | A | 1/2020 |
| CN | 110641850 | A | 1/2020 |
| CN | 110877780 | A | 3/2020 |
| CN | 111155855 | A | 5/2020 |
| CN | 111511663 | A | 8/2020 |
| CN | 111846649 | A | 10/2020 |
| CN | 112027293 | A | 12/2020 |
| CN | 112124741 | A | 12/2020 |
| CN | 112141485 | A | 12/2020 |
| CN | 112141531 | A | 12/2020 |
| CN | 212125891 | U | 12/2020 |
| CN | 212176867 | U | 12/2020 |
| CN | 112550970 | A | 3/2021 |
| CN | 112572949 | A | 3/2021 |
| CN | 212710519 | U | 3/2021 |
| CN | 212767373 | U | 3/2021 |
| CN | 102773618 | B8 | 4/2021 |
| CN | 112830112 | A | 5/2021 |
| CN | 112896827 | A | 6/2021 |
| CN | 213706178 | U | 7/2021 |
| CN | 113291648 | A | 8/2021 |
| CN | 113291649 | A | 8/2021 |
| CN | 214058247 | U | 8/2021 |
| CN | 214190562 | U | 9/2021 |
| CN | 214242101 | U | 9/2021 |
| CN | 113501220 | A | 10/2021 |
| CN | 214341424 | U | 10/2021 |
| CN | 214453818 | U | 10/2021 |
| CN | 109986255 | B | 11/2021 |
| CN | 214608970 | U | 11/2021 |
| CN | 214649733 | U | 11/2021 |
| CN | 214825035 | U | 11/2021 |
| CN | 214876350 | U | 11/2021 |
| CN | 214876351 | U | 11/2021 |
| CN | 214877271 | U | 11/2021 |
| CN | 113751935 | A | 12/2021 |
| CN | 113800079 | A | 12/2021 |
| CN | 113800080 | A | 12/2021 |
| CN | 113830393 | A | 12/2021 |
| CN | 215044727 | U | 12/2021 |
| CN | 215053960 | U | 12/2021 |
| CN | 215156568 | U | 12/2021 |
| CN | 215206473 | U | 12/2021 |
| CN | 215206475 | U | 12/2021 |
| CN | 215206546 | U | 12/2021 |
| CN | 215206547 | U | 12/2021 |
| CN | 215246236 | U | 12/2021 |
| CN | 215246257 | U | 12/2021 |
| CN | 215324662 | U | 12/2021 |
| CN | 215362933 | U | 12/2021 |
| CN | 113968400 | A | 1/2022 |
| CN | 215400729 | U | 1/2022 |
| CN | 215624175 | U | 1/2022 |
| CN | 215737787 | U | 2/2022 |
| CN | 215754314 | U | 2/2022 |
| CN | 215754342 | U | 2/2022 |
| CN | 105314294 | B | 3/2022 |
| CN | 114142137 | A | 3/2022 |
| CN | 114248993 | A | 3/2022 |
| CN | 215922843 | U | 3/2022 |
| CN | 215944818 | U | 3/2022 |
| CN | 216076045 | U | 3/2022 |
| CN | 216101731 | U | 3/2022 |
| CN | 216103278 | U | 3/2022 |
| CN | 216103904 | U | 3/2022 |
| CN | 216103927 | U | 3/2022 |
| CN | 111940971 | B | 4/2022 |

(56) References Cited

FOREIGN PATENT DOCUMENTS

| | | | |
|---|---|---|---|
| CN | 114275388 | A | 4/2022 |
| CN | 114313648 | A | 4/2022 |
| CN | 216195453 | U | 4/2022 |
| CN | 216234098 | U | 4/2022 |
| CN | 216402569 | U | 4/2022 |
| CN | 216467949 | U | 5/2022 |
| CN | 216508449 | U | 5/2022 |
| CN | 216510641 | U | 5/2022 |
| CN | 216510680 | U | 5/2022 |
| CN | 216547258 | U | 5/2022 |
| CN | 216547259 | U | 5/2022 |
| CN | 216547260 | U | 5/2022 |
| CN | 216547816 | U | 5/2022 |
| CN | 216564988 | U | 5/2022 |
| CN | 216564989 | U | 5/2022 |
| CN | 216581582 | U | 5/2022 |
| CN | 216617010 | U | 5/2022 |
| CN | 216637570 | U | 5/2022 |
| CN | 114620360 | A | 6/2022 |
| CN | 216685793 | U | 6/2022 |
| CN | 216709987 | U | 6/2022 |
| CN | 216762522 | U | 6/2022 |
| CN | 216762560 | U | 6/2022 |
| CN | 104909082 | B | 7/2022 |
| CN | 111874474 | B | 7/2022 |
| CN | 112325554 | B | 7/2022 |
| CN | 216888281 | U | 7/2022 |
| CN | 216888324 | U | 7/2022 |
| CN | 216896768 | U | 7/2022 |
| CN | 216944041 | U | 7/2022 |
| CN | 216944538 | U | 7/2022 |
| CN | 216995856 | U | 7/2022 |
| CN | 216995867 | U | 7/2022 |
| CN | 216995916 | U | 7/2022 |
| CN | 217049967 | U | 7/2022 |
| CN | 217049989 | U | 7/2022 |
| CN | 111746958 | B | 8/2022 |
| CN | 114852538 | A | 8/2022 |
| CN | 114940316 | A | 8/2022 |
| CN | 217100212 | U | 8/2022 |
| CN | 217199536 | U | 8/2022 |
| CN | 217202317 | U | 8/2022 |
| CN | 113525601 | B | 9/2022 |
| CN | 115036617 | A | 9/2022 |
| CN | 115043063 | A | 9/2022 |
| CN | 115072125 | A | 9/2022 |
| CN | 115133157 | A | 9/2022 |
| CN | 217372322 | U | 9/2022 |
| CN | 217375300 | U | 9/2022 |
| CN | 217436460 | U | 9/2022 |
| CN | 217436624 | U | 9/2022 |
| CN | 217436670 | U | 9/2022 |
| CN | 217436671 | U | 9/2022 |
| CN | 217444530 | U | 9/2022 |
| CN | 217478103 | U | 9/2022 |
| CN | 217478111 | U | 9/2022 |
| CN | 217492760 | U | 9/2022 |
| CN | 217503325 | U | 9/2022 |
| CN | 112027293 | B | 10/2022 |
| CN | 115199936 | A | 10/2022 |
| CN | 115240760 | A | 10/2022 |
| CN | 217599379 | U | 10/2022 |
| CN | 217599384 | U | 10/2022 |
| CN | 217599385 | U | 10/2022 |
| CN | 217599386 | U | 10/2022 |
| CN | 217624722 | U | 10/2022 |
| CN | 217650043 | U | 10/2022 |
| CN | 217673884 | U | 10/2022 |
| CN | 217673885 | U | 10/2022 |
| CN | 114084536 | B | 11/2022 |
| CN | 115298114 | A | 11/2022 |
| CN | 115303657 | A | 11/2022 |
| CN | 115321038 | A | 11/2022 |
| CN | 115367315 | A | 11/2022 |
| CN | 115410740 | A | 11/2022 |
| CN | 115411428 | A | 11/2022 |
| CN | 217731474 | U | 11/2022 |
| CN | 217755038 | U | 11/2022 |
| CN | 217788757 | U | 11/2022 |
| CN | 217806526 | U | 11/2022 |
| CN | 217918934 | U | 11/2022 |
| CN | 217919500 | U | 11/2022 |
| CN | 217919501 | U | 11/2022 |
| CN | 217919512 | U | 11/2022 |
| CN | 217919543 | U | 11/2022 |
| CN | 217919544 | U | 11/2022 |
| CN | 111619970 | B | 12/2022 |
| CN | 113460518 | B | 12/2022 |
| CN | 217945900 | U | 12/2022 |
| CN | 217945901 | U | 12/2022 |
| CN | 217946320 | U | 12/2022 |
| CN | 217970359 | U | 12/2022 |
| CN | 217999101 | U | 12/2022 |
| CN | 115557119 | A | 1/2023 |
| CN | 115593752 | A | 1/2023 |
| CN | 115610307 | A | 1/2023 |
| CN | 218199402 | U | 1/2023 |
| CN | 218229184 | U | 1/2023 |
| CN | 218229907 | U | 1/2023 |
| CN | 218344012 | U | 1/2023 |
| CN | 218368916 | U | 1/2023 |
| CN | 218390881 | U | 1/2023 |
| CN | 218401979 | U | 1/2023 |
| CN | 218401981 | U | 1/2023 |
| CN | 218401985 | U | 1/2023 |
| CN | 218401994 | U | 1/2023 |
| CN | 218405824 | U | 1/2023 |
| CN | 218406717 | U | 1/2023 |
| CN | 218406723 | U | 1/2023 |
| CN | 218406727 | U | 1/2023 |
| CN | 218409542 | U | 1/2023 |
| CN | 107235253 | B | 2/2023 |
| CN | 115703570 | A | 2/2023 |
| CN | 218513187 | U | 2/2023 |
| CN | 107226298 | B | 3/2023 |
| CN | 107237975 | B | 3/2023 |
| CN | 115725155 | A | 3/2023 |
| CN | 115817972 | A | 3/2023 |
| CN | 115818033 | A | 3/2023 |
| CN | 115818034 | A | 3/2023 |
| CN | 218559579 | U | 3/2023 |
| CN | 218559681 | U | 3/2023 |
| CN | 218704681 | U | 3/2023 |
| CN | 218704687 | U | 3/2023 |
| CN | 218705700 | U | 3/2023 |
| CN | 218752013 | U | 3/2023 |
| CN | 114249033 | B | 4/2023 |
| CN | 115892772 | A | 4/2023 |
| CN | 115892776 | A | 4/2023 |
| CN | 115946987 | A | 4/2023 |
| CN | 115953726 | A | 4/2023 |
| CN | 115958809 | A | 4/2023 |
| CN | 115973623 | A | 4/2023 |
| CN | 218807287 | U | 4/2023 |
| CN | 218859212 | U | 4/2023 |
| CN | 218876781 | U | 4/2023 |
| CN | 218887366 | U | 4/2023 |
| DE | 4429483 | A1 | 2/1996 |
| DE | 29703167 | U1 | 4/1997 |
| DE | G87152967 | U1 | 1/1998 |
| DE | 102009020599 | A1 | 11/2010 |
| EP | 0321859 | A2 | 6/1989 |
| EP | 1136389 | A2 | 9/2001 |
| EP | 1375355 | A2 | 1/2004 |
| EP | 1683727 | A1 | 7/2006 |
| EP | 2192021 | A2 | 6/2010 |
| EP | 4065911 | B1 | 11/2023 |
| JP | S51104837 | U | 8/1976 |
| JP | H07232789 | A | 9/1995 |
| JP | H09012133 | A | 1/1997 |
| JP | H10053222 | A | 2/1998 |
| JP | H1080671 | A | 3/1998 |
| JP | 2001278383 | A | 10/2001 |
| JP | 2005081534 | A | 3/2005 |

(56) References Cited

FOREIGN PATENT DOCUMENTS

| | | | |
|---|---|---|---|
| JP | 2007161258 | A | 6/2007 |
| JP | 3133715 | U | 7/2007 |
| JP | 2008100698 | A | 5/2008 |
| JP | 2016060532 | A | 4/2016 |
| JP | 2019001526 | A | 1/2019 |
| JP | 6859458 | B2 | 4/2021 |
| KR | 20120006954 | U | 10/2012 |
| KR | 200465521 | Y1 | 2/2013 |
| KR | 101375806 | B1 | 3/2014 |
| KR | 20170102666 | A | 9/2017 |
| KR | 101824568 | B1 | 3/2018 |
| NL | 1013830 | C2 | 6/2001 |
| TW | 201408550 | A | 3/2014 |
| WO | 9813284 | A1 | 4/1998 |
| WO | 0156898 | A1 | 8/2001 |
| WO | 2007111618 | A1 | 10/2007 |
| WO | 2007129986 | A1 | 11/2007 |
| WO | 2017058767 | A1 | 4/2017 |

OTHER PUBLICATIONS

European Patent Office, Extended European Search Report dated Oct. 4, 2023 for European Patent Application No. 20809120.7, 15 pages.

Patent Cooperation Treaty, International Search Report and Written Opinion of the International Searching Authority dated Jan. 5, 2022 for International Application No. PCT/IB2021/000622, 10 pages.

Patent Cooperation Treaty, International Search Report dated Mar. 3, 2022 for International Application No. PCT/IB2021/000764, 4 pages.

Patent Cooperation Treaty, International Search Report for International Application No. PCT/IB2020/000183 dated Jul. 17, 2020, 3 pages.

Patent Cooperation Treaty, International Search Report for International Application No. PCT/IB2020/000378 dated Sep. 1, 2020, 3 pages.

Patent Cooperation Treaty, Written Opinion of the International Searching Authority dated Mar. 3, 2022 for International Application No. PCT/IB2021/000764, 7 pages.

Patent Cooperation Treaty, Written Opinion of the International Searching Authority for International Application No. PCT/IB2020/000183 dated Jul. 17, 2020, 9 pages.

Patent Cooperation Treaty, Written Opinion of the International Searching Authority for International Application No. PCT/IB2020/000378 dated Sep. 1, 2020, 5 pages.

European Patent Office, Communication Pursuant to Rule 62 EPC, Supplementary European Search Report and Written Opinion dated Oct. 1, 2024 for European Patent Application No. 21888741.2, 8 pages.

Japan Patent Office, Notification of Reasons for Refusal for Japanese Patent Application No. 2023-526928 and English Translation dated Feb. 12, 2025, 9 pages.

Taiwan Intellectual Property Office, Search and Examination Report for Taiwan Patent Application No. 110140991 and English Translation dated Jan. 20, 2025, 46 pages.

* cited by examiner

COLLAPSIBLE CRATE

CROSS-REFERENCE TO RELATED APPLICATIONS

This application is a U.S. national phase application filed under 35 U.S.C. § 371 of International Application Number PCT/IB2021/000764, filed Nov. 1, 2021, designating the United States which claims benefit of U.S. Provisional Application No. 63/109,098, filed Nov. 3, 2020, which are hereby incorporated herein by reference in their entirety.

FIELD

The present disclosure generally relates to storage and transportation crates and, in particular, to collapsible crates.

BACKGROUND

Crates are used to transport and store goods and merchandise. When a crate is not being used, the crate typically takes up the same amount of space as when it is filled. Thus, when transporting or storing empty crates, the crates take up a lot of space on a transport vehicle or in a warehouse. Some crates have walls that are removeable from the base. The walls may then be removed and placed on top of the base of the crate or elsewhere for transportation or storage. In another approach, the walls of the crate may be folded inward and positioned on top of the base of the crate.

However, in the prior art approaches, the walls remain vulnerable to impact and damage. Further, the walls may still take up additional space beyond the general dimensions of the base. Moreover, many crates are transported using forklifts and similar tools. To accommodate such tools, crates must be configured with bases that accept the lifting and transporting structure. When bases are configured in this manner, it can be especially difficult to configure a crate that permits one or more walls to collapse onto the base.

A need exists for a crate that can be collapsed to reduce its size while still preventing the walls from becoming bent, dented, or disassociated from the rest of the crate.

DETAILED DESCRIPTION

A crate is provided that is configured to permit the walls of the crate to be detached from one another and stored within a cavity in the base of the crate. When collapsing the crate from an assembled configuration, a wall may be detached from the adjacent walls. The upper portion of the wall may be rotated outward about the lower end of the wall that is attached to the base and engages a track of the base. Once the wall is substantially parallel to the ground, the wall may be slid into a cavity under the base via the track within the base that receives the wall. The base may include a retaining mechanism for preventing the walls from unintentionally sliding out of the cavity of the base. Each wall may similarly be disconnected from the adjacent walls and stored within the base.

Figure 2:
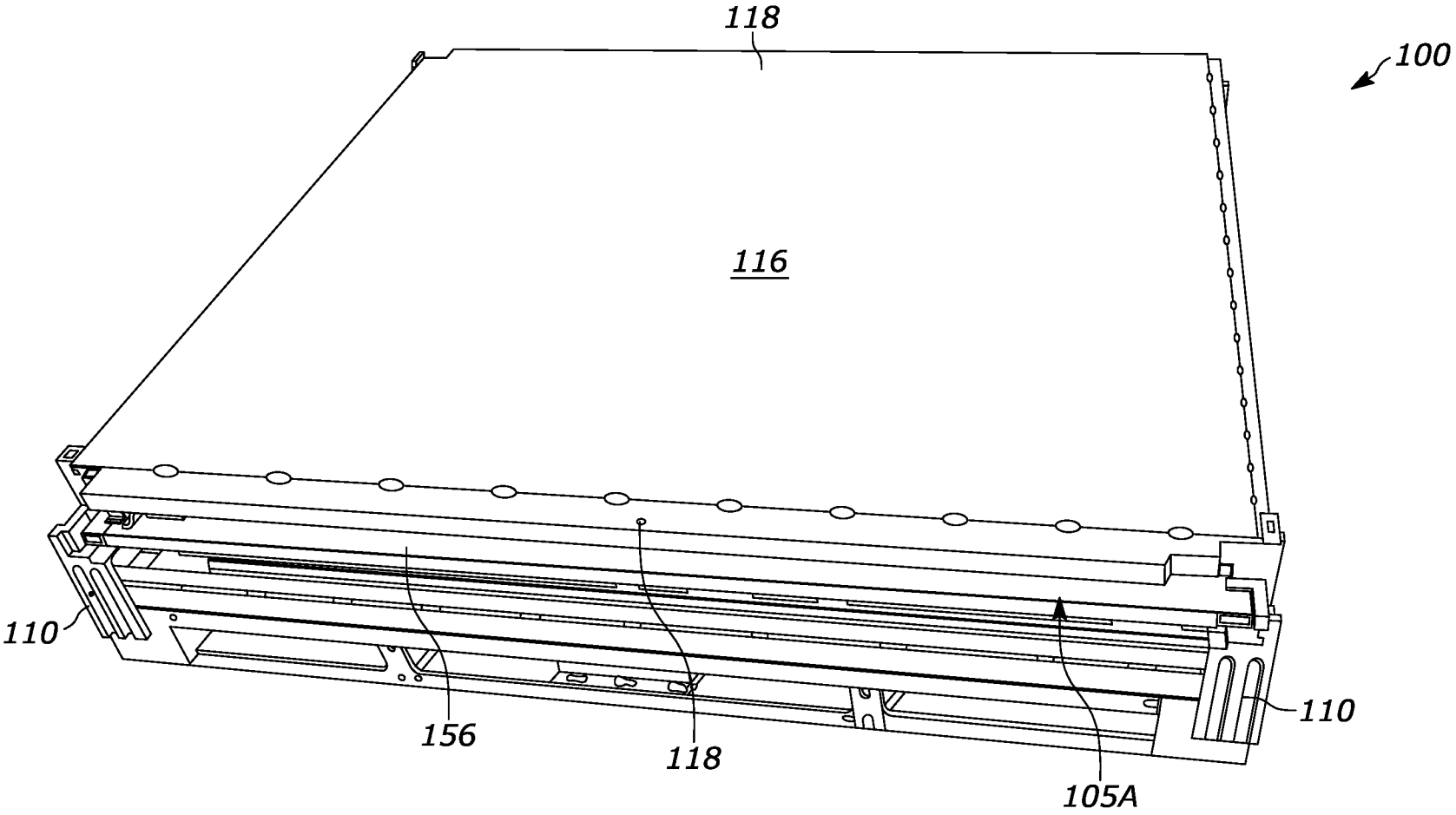
FIG. 2 is a top perspective view of the collapsible crate of FIG. 1A in a collapsed configuration.
Figure 3A:
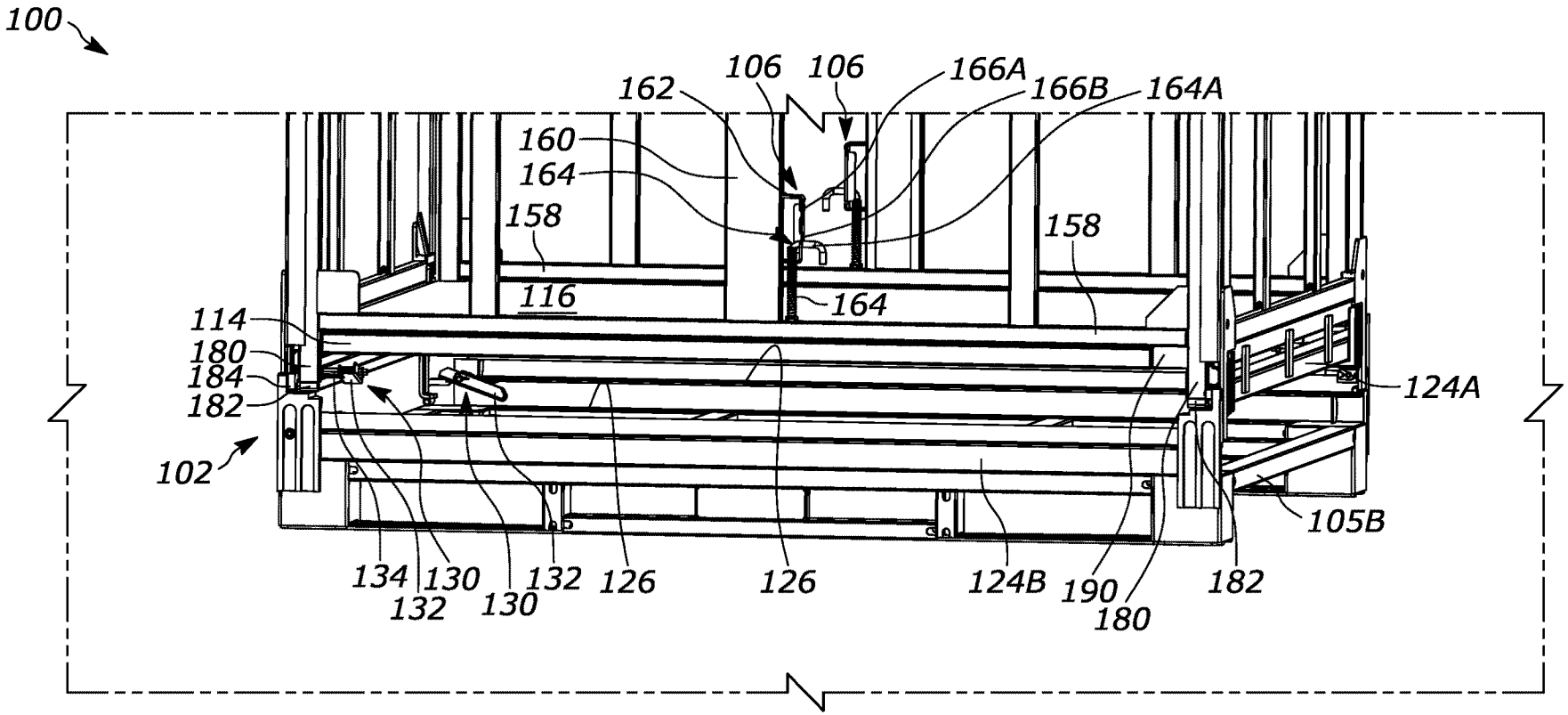
FIG. 3A is a front perspective view of a lower portion of the collapsible crate of FIG. 1A.
Figure 3B:
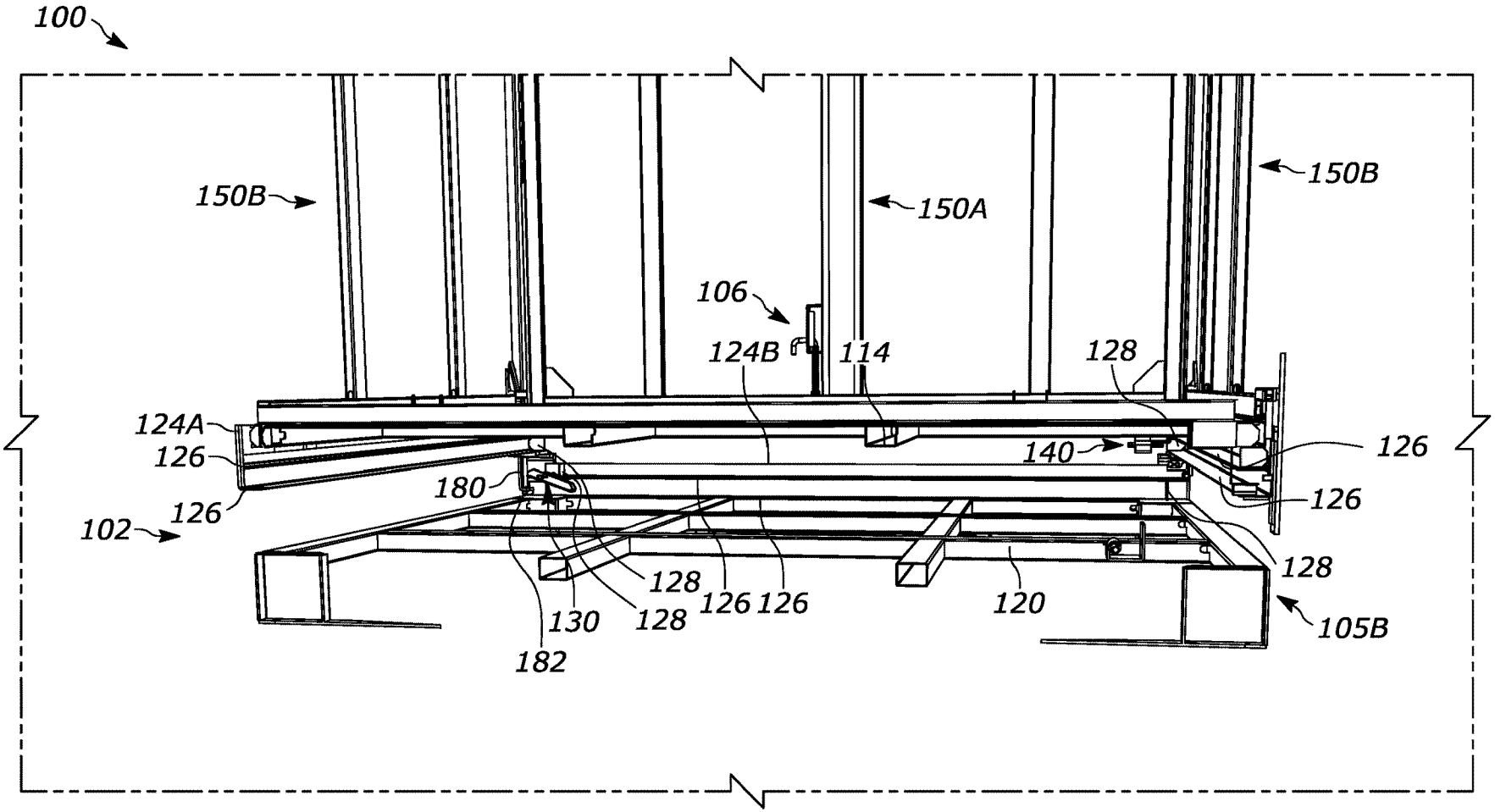
FIG. 3B is a front cross-section view of a lower portion of the collapsible crate of FIG. 1A.
Figure 3C:
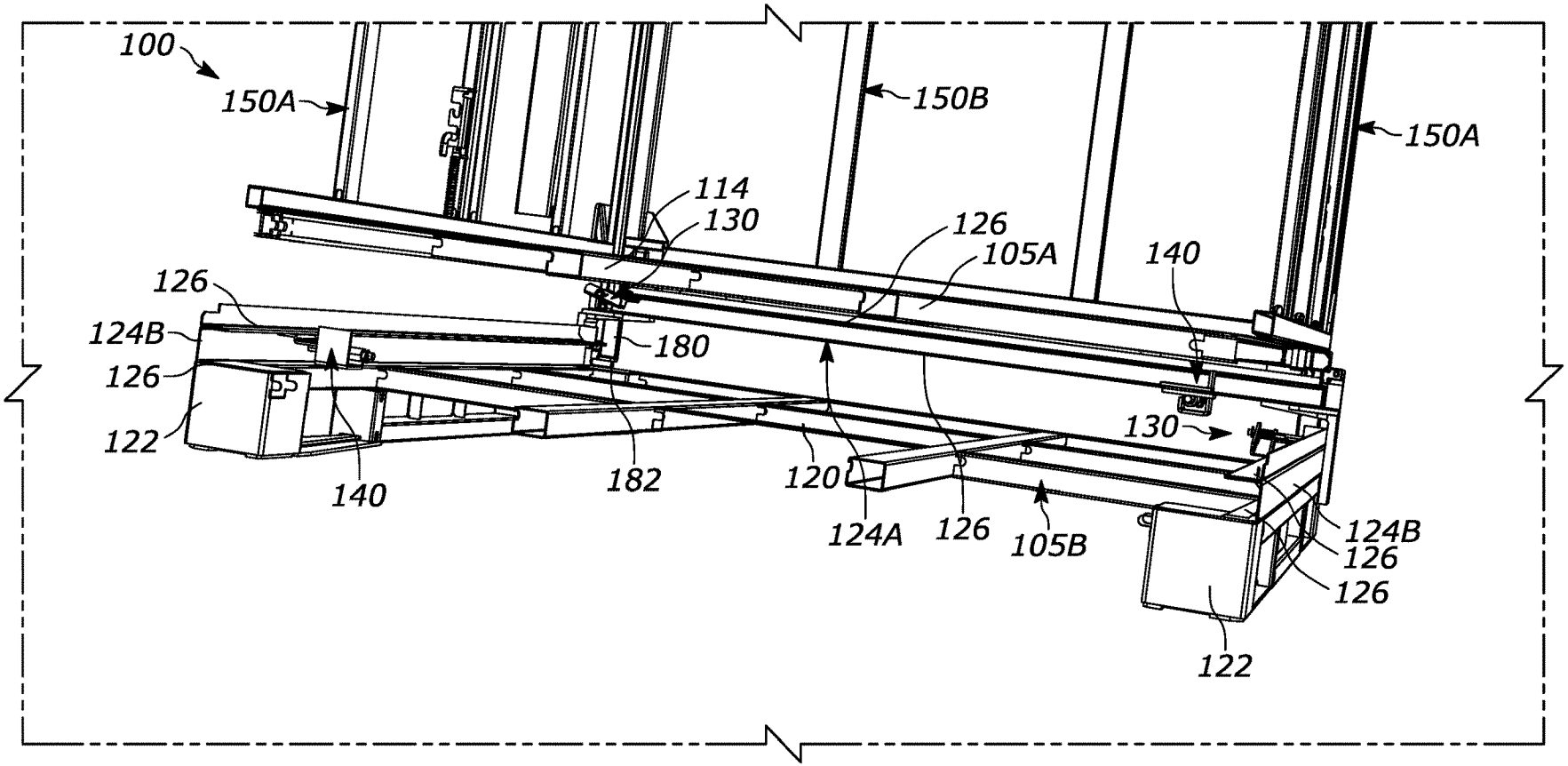
FIG. 3C is a perspective view of a right side cross-section of a lower portion of the collapsible crate of FIG. 1A.

With reference to FIG. 1A-G, the crate 100 is shown in an assembled configuration and includes a base 102 and four walls 150A,B extending upward from the base 102. As shown in FIG. 2, the crate is in a collapsed configuration with all four walls 150A,B within the base 102. With reference also to FIGS. 3A-C, in one form, the base 102 includes an upper platform 105A, a lower platform 105B, and four vertical posts 110 extending between the upper platform 105A and lower platform 105B. The base 102 thus defines a space between the upper platform 105A and the lower platform 105B which is a cavity 112 of the base 102. The upper platform 105A and lower platform 105B may be formed of a grid of support bars spanning the top and bottom of the base 102. In other forms, the upper platform 105A and the lower platform 105B may be formed of a solid, flat sheet, such as a sheet metal.

In one form, the upper platform 105A includes a frame 114 formed from a grid of support members and a bottom wall 116 mounted to the top side of the frame 114. The bottom wall 116 provides a surface for contents within the crate 100 to rest on. Because the walls 150A,B are moved within the base 102 to collapse the crate 100 (and do not rest on the bottom wall 116), the crate 100 may be moved between the assembled and collapsed configuration without the need to remove the contents positioned on the bottom wall 116. This enables one or more walls 150A,B to collapse to provide access to the contents of the crate 100, for example, when removing items from the crate. The crate 100 may also be used similar to a pallet when in the collapsed configuration for supporting contents on the surface 116. The crates 100 may be stacked on one another when in the collapsed configuration to conserver space. With the walls within the base 102 in the collapsed configuration, the walls 105A,B are protected from damage when the crates 100 are stacked and transported. The bottom wall 116 may be formed of a sheet metal to provide a flat surface that is strong and durable. In other embodiments, the bottom wall 116 is a mesh or grid, such that it is not a solid surface. In other forms, the bottom wall 116 may be formed of other materials, such as wood, polymers, etc., and combinations thereof. The at least one of the upper platform 105A and the bottom wall 116 includes holes 118 on the sides facing locking walls 150A for receiving a locking pin 164 of a wall orientation locking mechanism 106 of the locking wall 150A to lock the wall 150A in an upright position as will be described in further detail below.

The lower platform 105B includes a frame 120 formed of a grid of support members. The lower platform 105B includes support blocks 122 extending downward from each corner of the lower platform 105B. The support blocks 122 rest on the ground and space the lower platform 105B away from the ground enabling the crate 100 to be picked or moved by moving equipment such as a forklift, pallet jack, or similar tool. The lower platform 105B is below the cavity 112 into which the walls 150A,B are moved in a collapsed configuration which allows forks of moving equipment to be positioned below the lower platform 105B when the crate 100 is in both the assembled and collapsed configurations.

With reference to FIGS. 3A-C, the base 102 further includes sidewalls 124A,B extending between the vertical posts 110 in between the upper platform 105A and the lower platform 105B. The sidewalls 124A,B thus extend along the cavity 112 of the base 102. The sidewalls 124A,B include support structure forming tracks for receiving the walls 150A,B within the base 102. In one form, the sidewalls 124A on the left and right sides of the crate 100 are at the same height. In one form, sidewalls 124B on the front and rear of the crate 100 are at the same height as one another, but at a different height than the sidewalls 124A. As shown, the sidewalls 124A are lower or closer to the lower platform 105B than the sidewalls 124B. Each of the sidewalls 124A,B include an upper and a lower ledge 126 extending along the length of the sidewall 124A,B that extend horizontally inward from the sidewalls 124A,B. It should be appreciated that other forms of support structure in the base 102 for guiding and/or storing the walls 150A,B may also be used. For example, the base 102 may include four solid, sheets spanning the cavity 112 of the base 102 and forming four levels within the cavity 112 for receiving the walls 120A,B thereon. In another example, the sidewalls 124A,B may include U-shaped members rather than ledges 126 for receiving a side of a wall 150A,B.

In the embodiment shown, each ledge 126 of the sidewalls 124A,B corresponds with a ledge 126 on the sidewall 124A,B on the opposite side of the base 102 to form a track for receiving the walls 150A,B of the crate 100. For example, the lower ledge 126 of the sidewall 124A of the left side of the base 102 is at the same height as the lower ledge 126 of the sidewall 124A on the right side of the base 102. The upper ledge 126 of the sidewall 124A on the left side of the base 102 is at the same height as the upper ledge 126 of the sidewall 124A on the right side of the base 102. The ledges 126 of the sidewalls 124B similarly correspond with one another. This creates four levels of ledges 126 or tracks within the cavity 112 of the base 102 for receiving the four walls 150A,B of the crate 100. For instance, when the crate 100 is in the collapsed configuration as shown in FIG. 2, the walls 150A of the crate 100 are within the cavity 112 of the base 102. A first side of the wall 150A,B rests on a ledge 126 while the second side of the wall 150A,B rests on the corresponding ledge 126 of the opposite side of the base 102. The ledges 126 thus each form a portion of a track that receives a wall 150.

The ledges 126 may include stops 128 at an end thereof against which the walls 150A,B abut when inserted into the cavity 112 of the base 102. The stops 128 prevent the walls 150A,B from being inserted too far into the cavity 112 and from exiting the base 102 on the opposite side of the crate 100 from which the wall 150A,B was inserted. The base 102 also includes retaining members 130 and latches 140 that are used for retaining the walls 150A,B within the base 102 when the crate 100 is in the collapsed configuration. As described in further detail below, the retaining members 130 and latches 140 engage a portion of the walls 150A,B to prevent the walls 150A,B from unintentionally sliding out from the cavity 112 of the base 102.

With reference again to FIGS. 1A-G, each of the walls 150A,B may be formed of a frame having a left side member 152, a right side member 154, a top member 156, and a bottom member 158. The walls 150A,B includes a plurality of vertical bars spaced extending between the top member 156 and the bottom member 158. In other forms, the walls 150A,B may additionally or alternatively include horizontally extending bars. In yet other forms, the walls 150A,B may be solid and not include openings therethrough. In the embodiment shown, there are two types of walls 150. The first type is locking wall 150A and the second type is the connecting wall 150B. In the assembled configuration, the locking walls 150A are on opposite sides of the crate 100 and the connecting walls 150B extend between the locking walls 150A along the remaining two sides of the crate 100. As shown, the locking walls 150A include a wall orientation locking mechanism 106 and two wall locking mechanisms 108. The bottom member 158 of the locking wall 150A includes a hole 158A used for locking the locking wall 150A in an upright position. The left side member 152 and the right side member 154 each include a slot 159A used for locking the locking wall 150A to the adjacent connecting walls 150B. The connecting walls 150B each include slots 159B in the left side member 152 and the right side member 154 that align with slots 159A of the locking walls 150A and are used for locking the locking wall 150A to the connecting walls 150B. It should be appreciated that the while the locking walls 150A are shown to include both the wall orientation locking mechanism 106 and two wall locking mechanisms 108, in other forms each wall of the crate 100 may include a wall locking mechanism 108 for locking to an adjacent wall. In some forms, each wall of the crate 100 includes a wall orientation locking mechanism 106. In some forms, each locking wall 150A includes two wall orientation locking mechanisms 106. In other forms, none of the walls include a wall orientation locking mechanism 106.

Figure 4A:
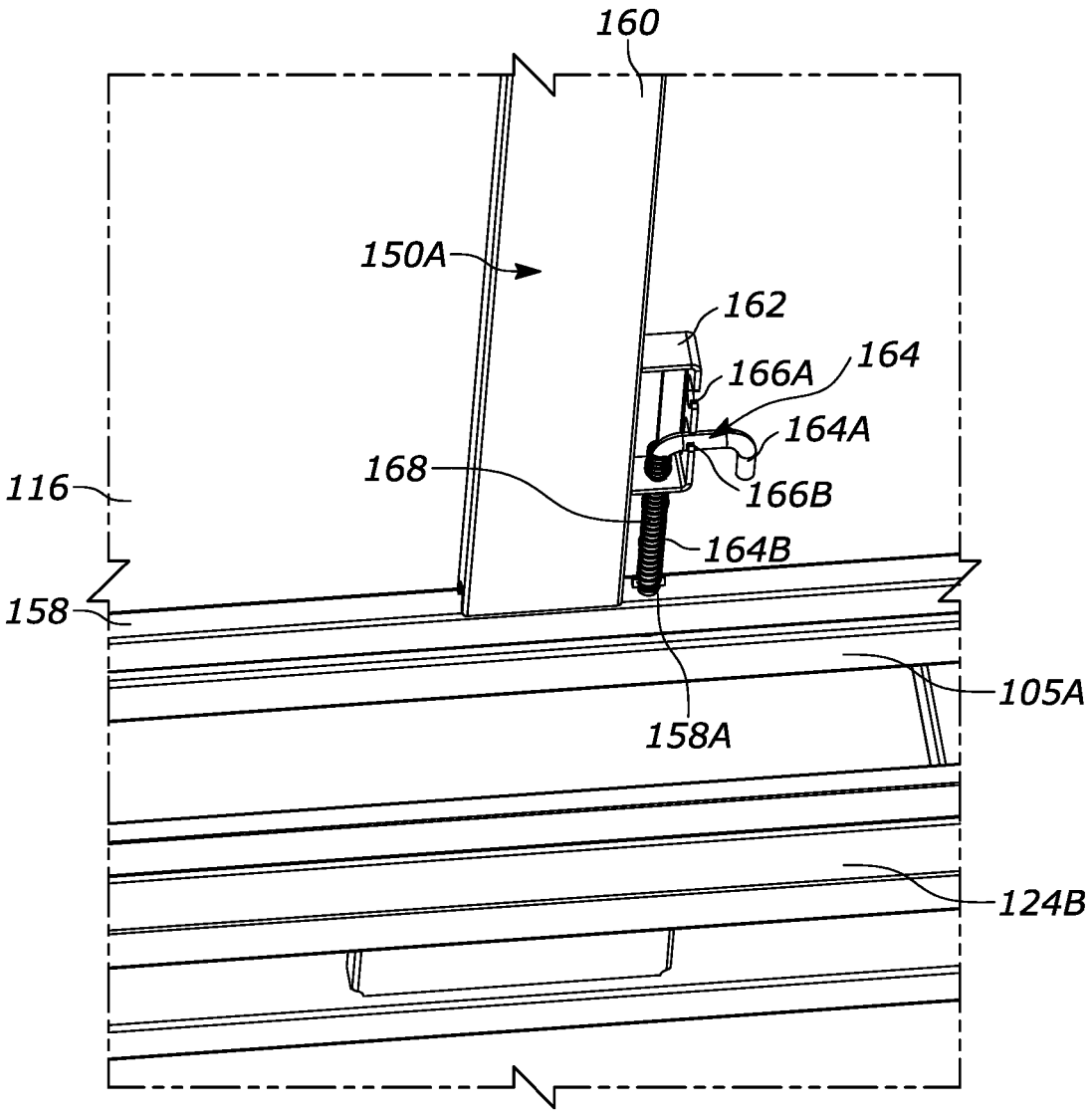
FIG. 4A is a top perspective view of a wall orientation locking mechanism of the collapsible crate of FIG. 1A.

The wall orientation locking mechanism 106 of the locking walls 150A includes structure to lock the locking walls 150A in an upright position. With reference to the embodiment shown in FIG. 4A, the wall orientation locking mechanism 106 includes a bracket 162 that is attached to a vertical member 160 of the locking wall 150A and a locking pin 164 having a handle portion 164A and a shaft portion 164B. The bracket 162 includes an upper notch 166A and a lower notch 166B that receives the handle portion 164A of the locking pin 164 when the locking pin 164 is in the unlocked and locked configurations, respectively. In the embodiment shown, the bracket 162 is substantially U-shaped. It should be appreciated that the in other forms the bracket retaining the locking pin 164 in the locked and unlocked positions has an alternative shape, but includes structure for the handle portion 164A of the locking pin 164 to engage when in the locked and unlocked positions for retaining the locking pin 164.

In operation, to lock the locking wall 150A into an upright position, the shaft portion 164B of the locking pin 164 is extended through the hole 158A bottom member 158 of the locking wall 150A and into the hole 118 of the bottom wall 116 of the base 102. The handle portion 164A of the locking pin 164 may be rotated into the lower notch 166B of the U-shaped bracket 162 to keep the locking pin 164 inserted within the hole 118 of the base 102. The wall orientation locking mechanism 106 may include a spring 168 that biases the locking pin 164 upward from the bottom member 158 of the locking wall 150A. When received within the lower notch 166B of the U-shaped bracket 162, the spring 168 biases the handle portion 164A into engagement with an upper portion of the lower notch 166B, thereby increasing the frictional engagement between the handle portion 164A and the lower notch 166B which aids to prevent the handle portion 164A of the locking pin 164 from rotating outward from the notch 166B.

To unlock the locking wall 150A to allow the locking wall 150A to be rotated from the upright position, the handle portion 164A of the locking pin 164 is rotated out from the lower notch 166B of the U-shaped bracket 162. The locking pin 164 may be moved upward to withdraw the locking pin 164 from the hole 118 of the bottom wall 116. The handle portion 164A may be rotated into the upper notch 166A to retain the locking pin 164 in the unlocked position. The spring 168 may bias the locking pin 164 into the unlocked position, and, when the handle portion 164A is in the upper notch 166A, the spring 168 may bias the handle portion 164A against an upper portion of the upper notch 166A to thereby increase the frictional engagement between the handle portion 164A to prevent the handle portion 164A from rotating outward from the notch 166A.

The wall locking mechanisms 108 include structure to removably connect two walls together. It should be appreciated that while a specific structure for the wall locking mechanism 108 is shown, in other forms the wall locking mechanism 108 may be any structure to reversibly fasten two adjacent walls together. With reference to FIGS. 5B-C, the wall locking mechanism 108 shown includes a support bracket 170 and a locking pin 172 having a handle portion 172A, a shaft portion 172B, and hook portion 172C. The support bracket 170 includes a hole for receiving the shaft portion 172B of the locking pin 172 therethrough. The support bracket 170 guides the shaft portion 172B of the locking pin 172 as the locking pin 172 is moved between connected and disconnected configurations. In the connected configuration, the locking pin 172 is moved toward the edge of the wall 150A and in the disconnected configuration the locking pin 172 is moved toward the middle of the wall 150A. The handle portion 172A of the locking pin 172 is attached to the shaft portion 172B of the locking pin 172 to move the locking pin 172 between connected and disconnected configurations and to rotate the locking pin 172 about the shaft portion 172B between locked and unlocked positions. The hook portion 172C is attached to an end of the shaft portion 172B that, when moving from the disconnected configuration to the connected configuration, is passed through a slot 159A in the locking wall 150A and a corresponding slot 159B in the adjacent connecting wall 150B. The hook portion 172C is shaped such that when it is aligned with the slots 159A, 159B of the locking wall 150A and the connecting wall 150B, it is in the unlocked configuration and the hook portion 172C may be passed therethrough. When the hook portion 172C is not in alignment with the slots 159A,B, the hook portion 172C is in the locked configuration and is not able to be passed therethrough. Thus, when the locking pin 172 is in the connected configuration with the hook portion 172C passed through the slots 159A,B and the misaligned with the slots 159A,B (i.e., in the locked configuration), the locking pin 172 cannot be withdrawn from the slots 159A,B without first aligning the hook portion 172C with the slots 159A,B (i.e., moving the locking pin 172 to the unlocked configuration).

In operation, to lock a locking wall 150A to an adjacent connecting wall 150B, the locking pin 172 is rotated, for example using the handle portion 172A, to the unlocked configuration to align the hook portion 172C with the slots 159A, 159B of the locking wall 150A and the connecting wall 150B. The locking pin 172 is then moved from the disconnected configuration to the connected configuration by moving the locking pin 172 along the axis of the shaft portion 172B to pass the hook portion 172C through the slots 159A, 159B of the locking wall 150A and the connecting wall 150B. The locking pin 172 is then moved to the locked configuration by rotating the hook portion 172C so that the hook portion 172C is no longer aligned with the slots 159A, 159B and thus is not able to be withdrawn through the slots 159A, 159B.

To unlock the locking wall 150A from the connecting wall 150B, the locking pin 172 is moved to the unlocked configuration, e.g., by rotating the handle portion 172A about the shaft portion 172A to bring the hook portion 172C into alignment with the slots 159A, 159B of the locking wall 150A and the connecting wall 150B. The locking pin 172 is then moved to the disconnected configuration by withdrawing the hook portion 172 from the slots 159A, 159B by moving locking pin 172A along the axis of the shaft portion 172A of the locking pin 172. Once the hook portion 172C of the locking pin 172 is no longer extending through the slot 159B of the connecting wall 150B, the connecting wall 150B is disconnected from the locking wall 150A. The locking pin 172 may then be rotated to the locked position for storage.

In the embodiment shown in FIGS. 1A-G, the hook portion 172C of the locking pin 172 is in the unlocked configuration or in alignment with the slots 159A, 159B of the locking wall 150A and the connecting wall 150B when the handle portion 172B is rotated such that the handle portion 172B extends substantially perpendicularly from the locking wall 150A. The hook portion 172C is in the locked configuration or no longer in alignment with the slots 159A, 159B when the handle portion 172B is parallel with the locking wall 150A. Since the handle portion 172B is normally parallel with the locking wall 150A when the locking wall 150A is in an upright position due to the force of gravity, the hook portion 172C is normally not aligned with the slots 159A, 159B thus causing the locking pin 172 to be normally in the locked configuration.

Figure 4B:
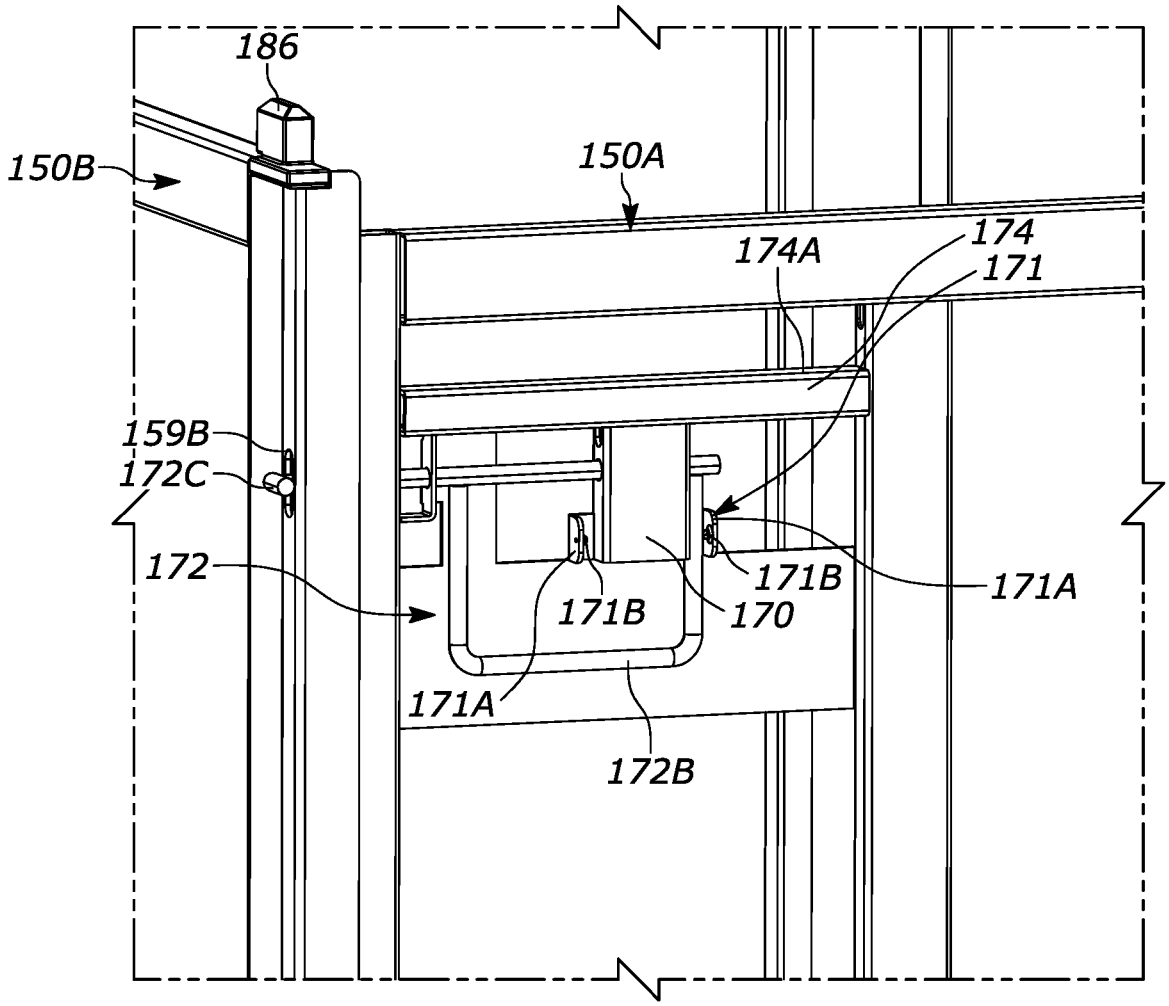
FIG. 4B is a left perspective view of a wall connection mechanism of the collapsible crate of FIG. 1A.
Figure 4C:
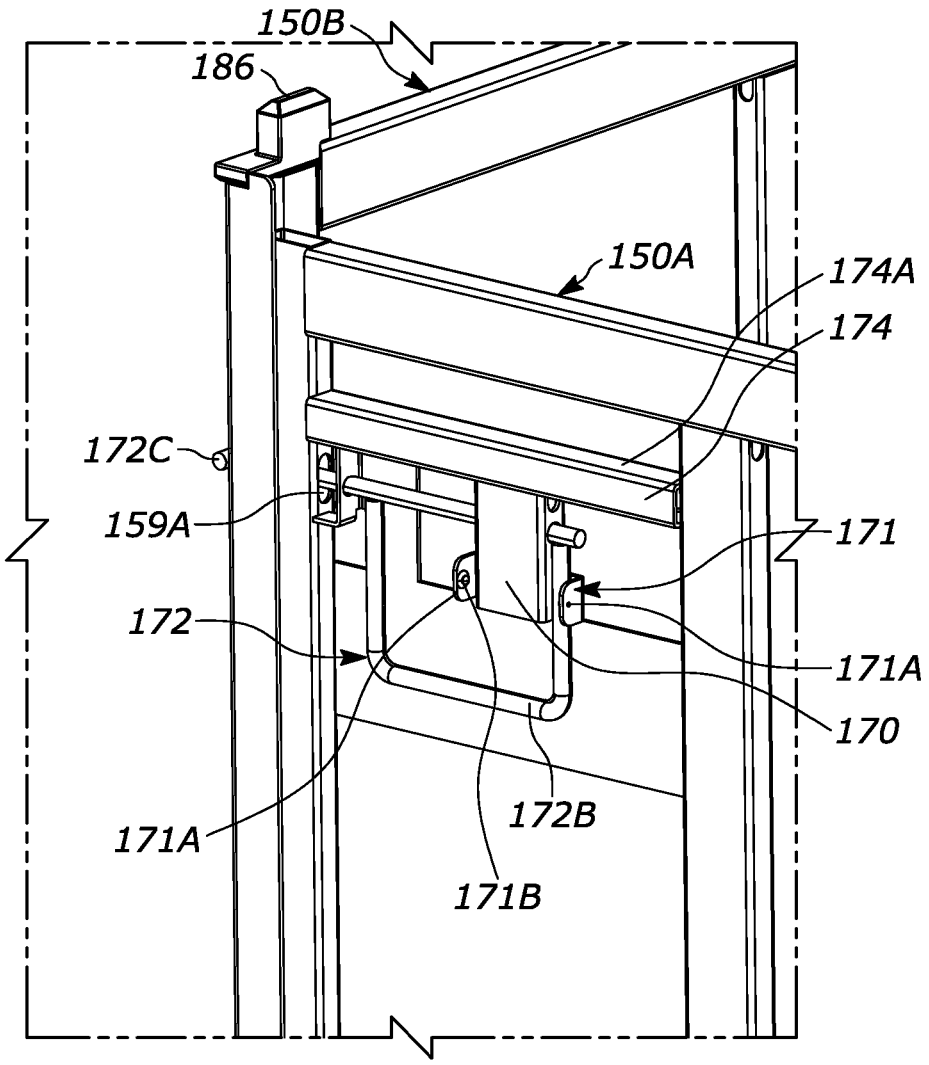
FIG. 4C is a right perspective view of the wall connection mechanism of FIG. 4B.

The support bracket 170 further includes a handle retaining bracket 171 that receives the handle portion 172B of the locking pin 172 when the locking pin 172 is in the locked configuration and also in one of the connected and disconnected configurations. With reference to FIG. 4B-C, the handle retaining bracket 171 includes arms 171A extending from the support bracket 170. Each arm 171A includes a protrusion 171B extending inward from a portion of the arm 171A toward the support bracket 170. The handle portion 172B of the locking pin 172 includes a portion that is sized to be received between the protrusion 171B of the arm 171A and the support bracket 170. The protrusion 171B restricts the space between the arm 171A and the support bracket 170 such that the handle portion 172B must be forcibly inserted or removed from the handle retaining bracket 171. The handle portion 172B may be retained by the handle retaining bracket 171 in both the disconnected and connected configurations. The handle retaining bracket 171 thus prevents the handle portion 172B from swinging about the shaft portion 172A to thereby secure the locking pin 172 in a locked configuration, for example, to prevent the locking wall 150A and the connecting wall 150B from being unintentionally disconnected from one another when in the connected configuration.

Figure 1A:
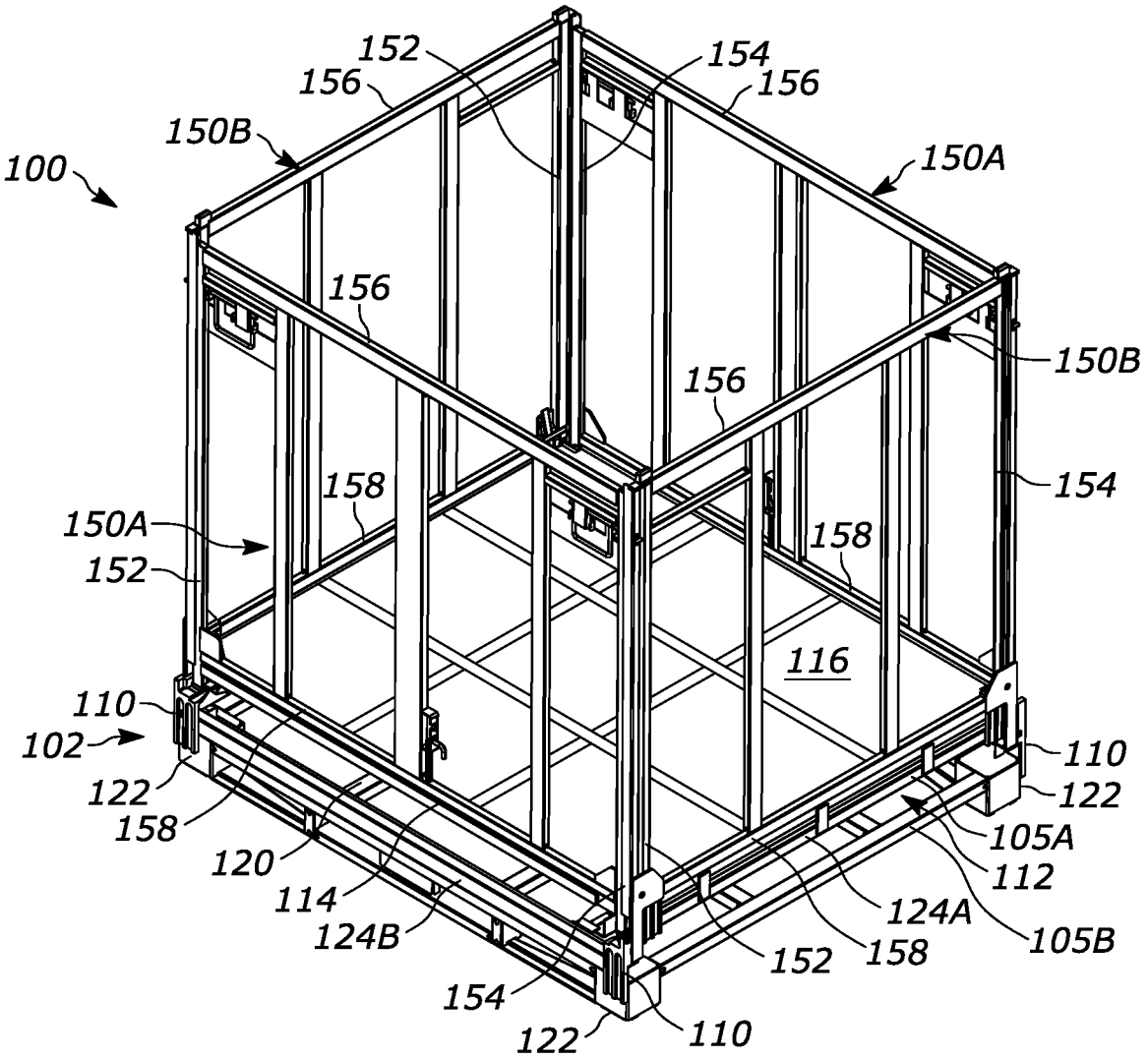
FIG. 1A is a top perspective view of a collapsible crate in an assembled configuration.
Figure 1B:
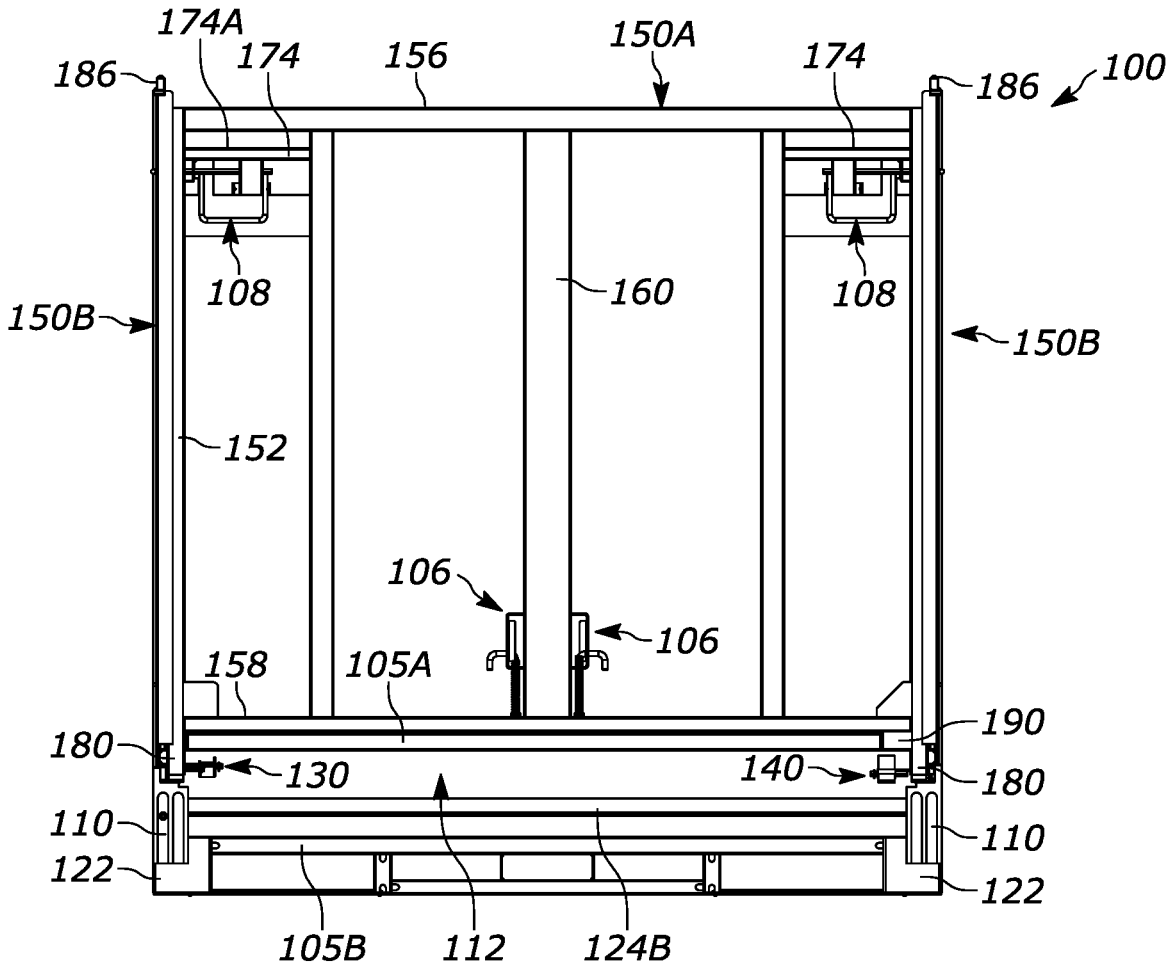
FIGS. 1B-C are front and rear elevation views, respectively, of the collapsible crate of FIG. 1A.
Figure 1C:
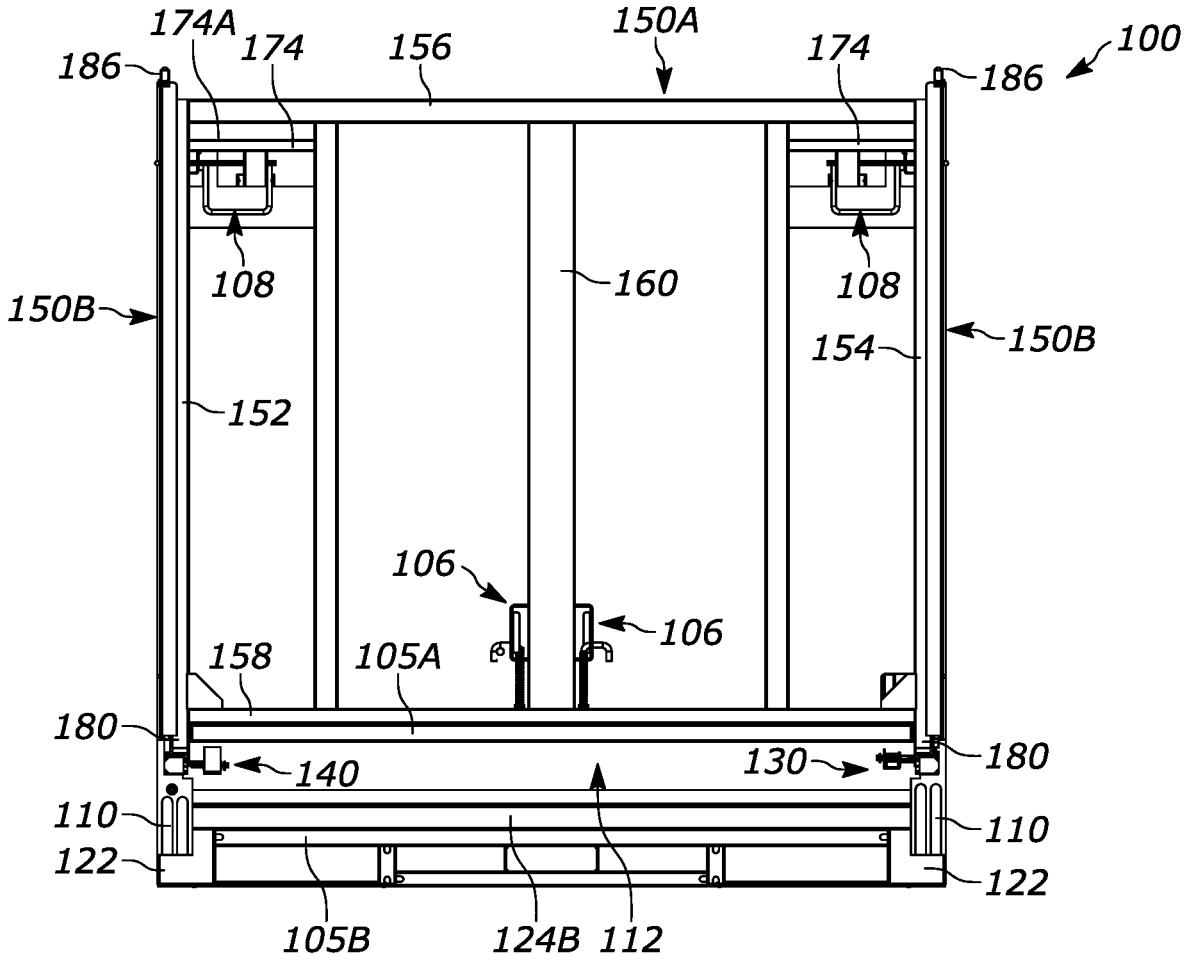
Figure 1D:
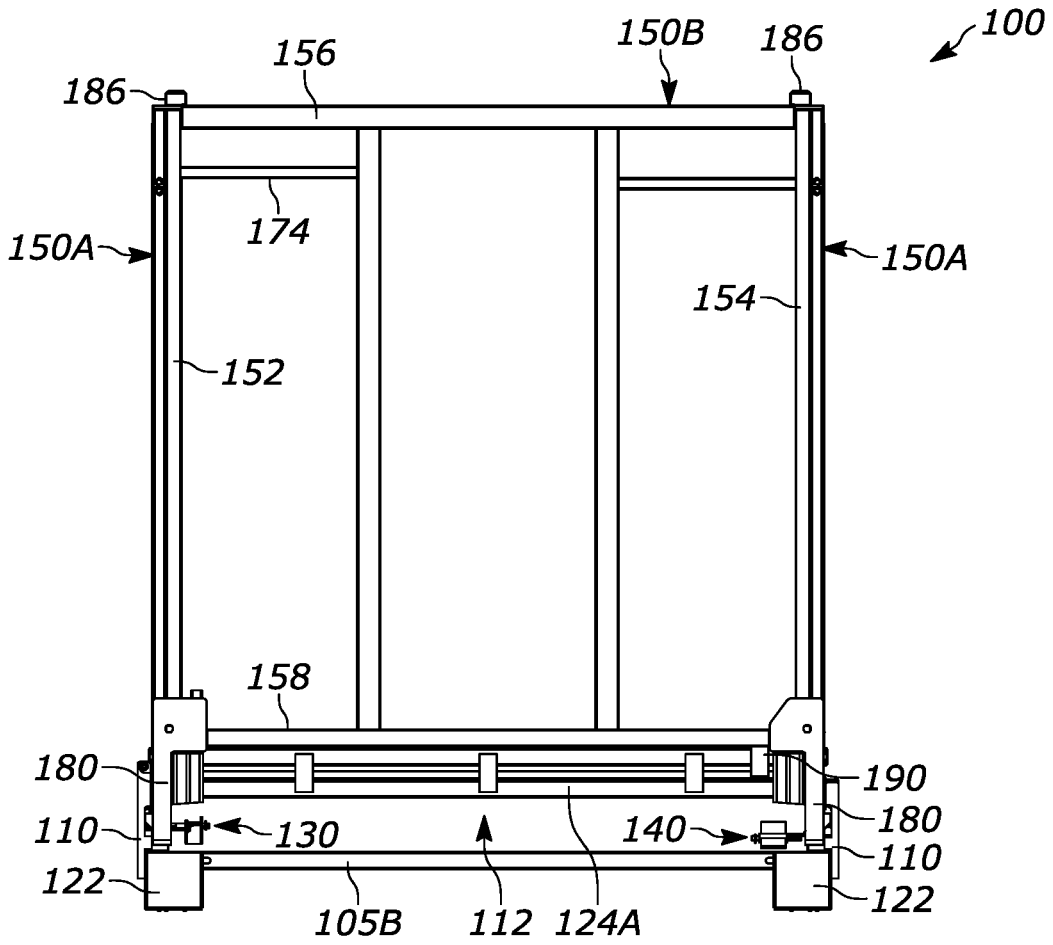
FIGS. 1D-E are left and right side elevation views, respectively, of the collapsible crate of FIG. 1A.
Figure 1E:
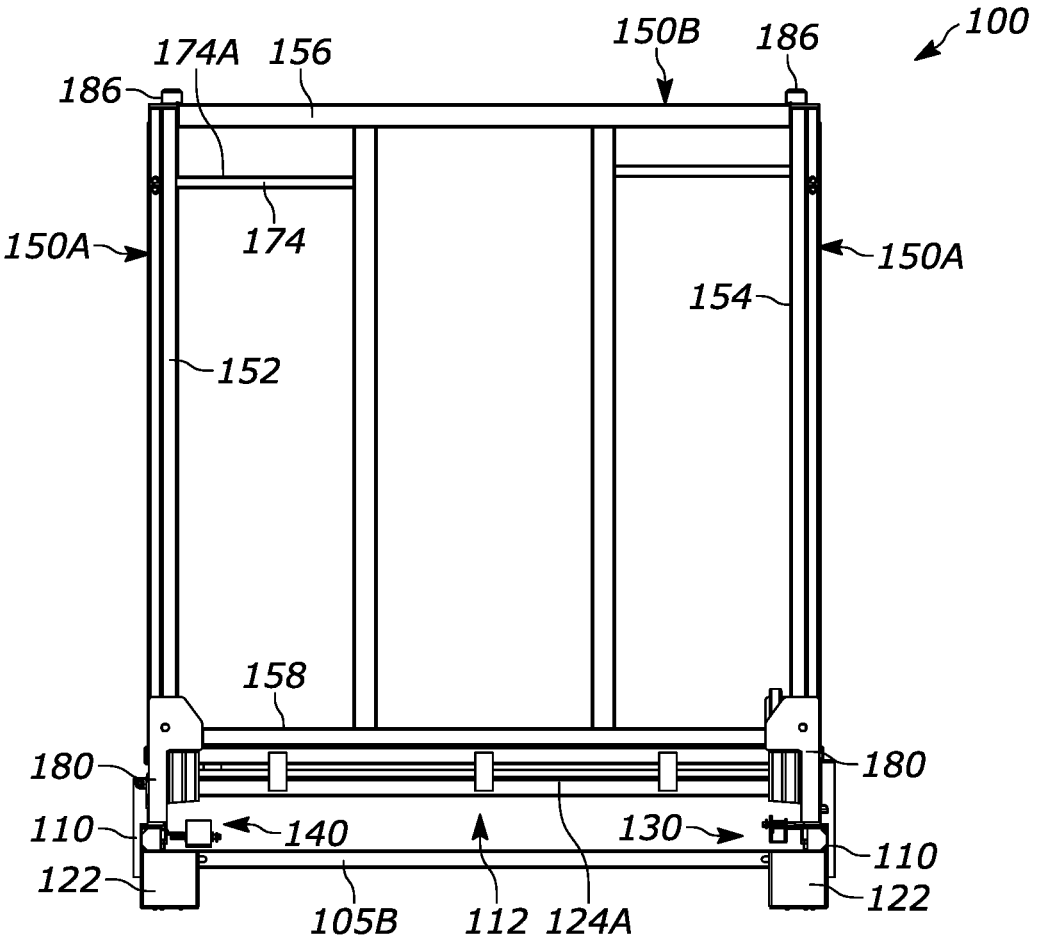
Figure 1F:
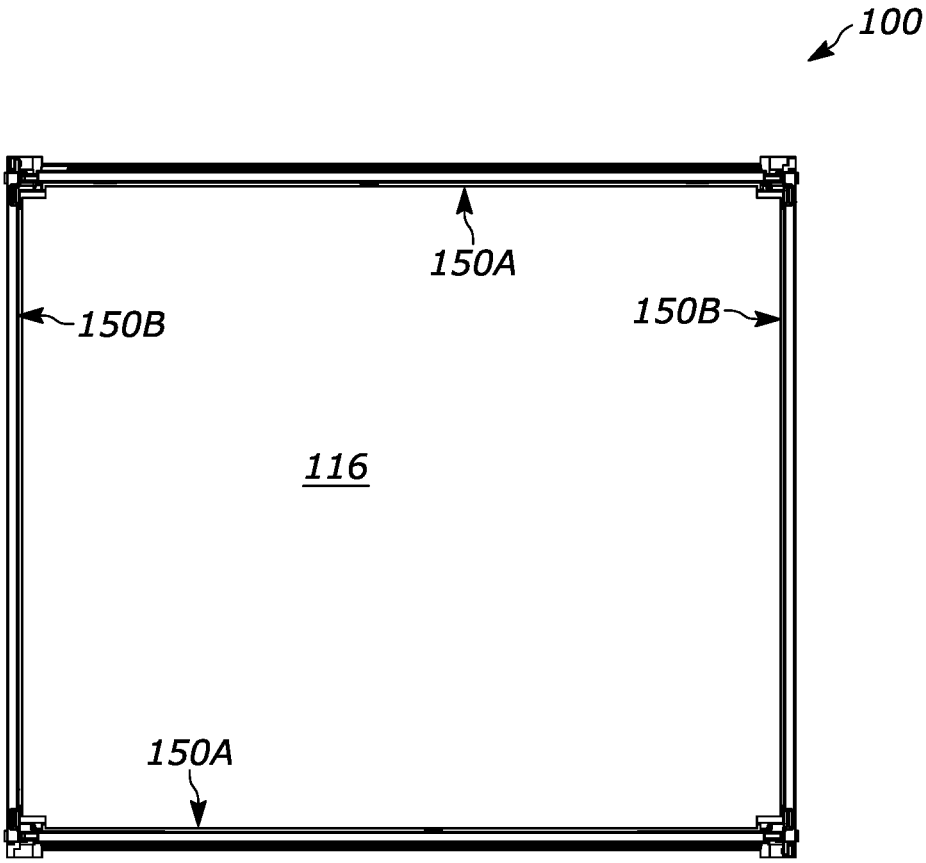
FIGS. 1F-G are top and bottom plan views, respectively of the collapsible crate of FIG. 1A.
Figure 1G:
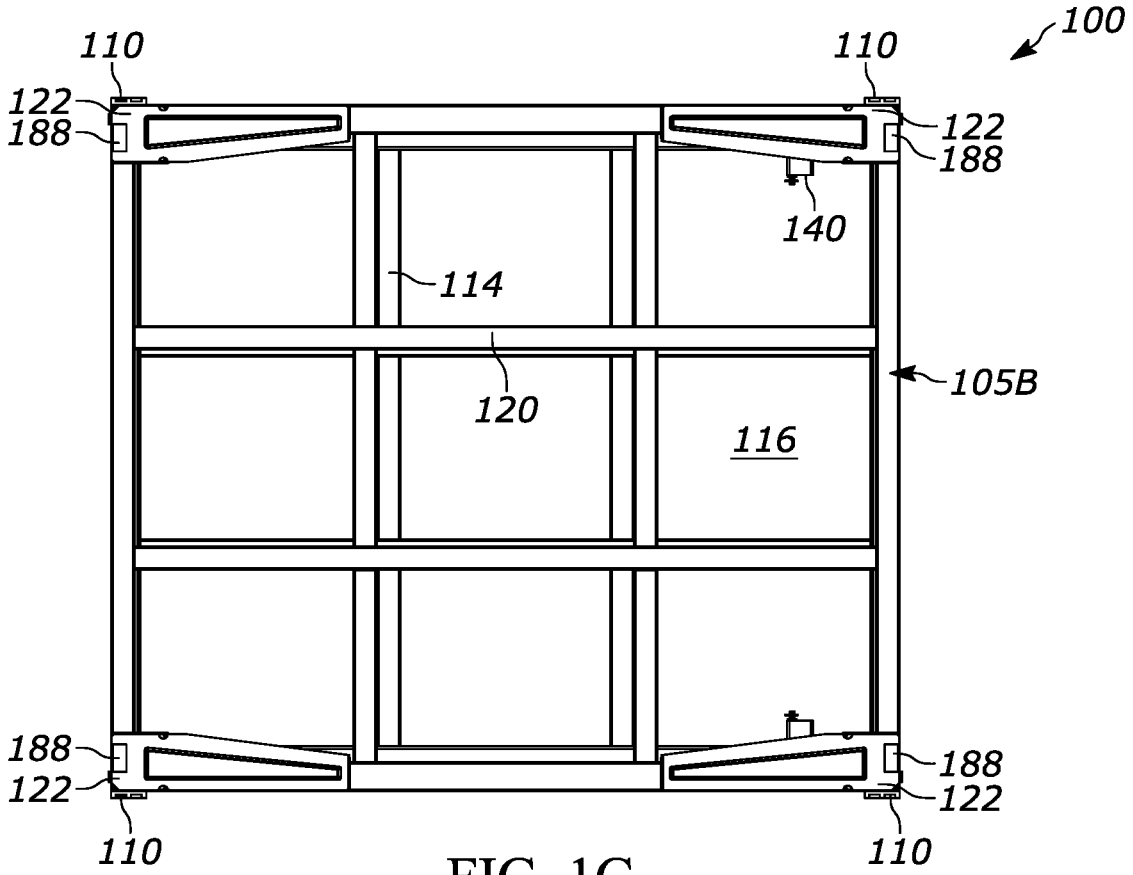

As shown in FIGS. 1B and 1D, one locking wall 150A and one connecting wall 150B include a latch engaging member 190. The latch engaging member 190 may be a plate that extends below the bottom member 158 of the wall 150A,B. As explained in further detail below, when the locking wall 150A or the connecting wall 150B are slid into the cavity 112 along their respective tracks within the base 102, the latch engaging member 190 engages a latch 140 of the base 102, causing the latch 140 to rotate to extend into the pathway of the track of the wall immediately above the wall 150A,B to thereby retain the wall 150A,B above in the base 102.

Each of the walls 150A,B include a crossbar 174. The crossbar 174 engages a corresponding retaining member 130 or latch 140 of the base 102 when the crate 100 is in the collapsed configuration such as that shown in FIG. 2 that prevent the walls 150A,B from sliding out of the cavity 112 of the base 102 when in the collapsed configuration. In the example embodiment shown, the crate 100 includes a retaining member 130 for one locking wall 150A and one connecting wall 150B and a latch 140 for one locking wall 150A and one connecting wall 150B. In another embodiment, the crate 100 may include a retaining member 130 for all of the walls 150. Also in the embodiment shown, one retaining member 130 or latch 140 is used for each wall 150A,B at the left portion of the track for receiving the wall 150A,B into the base 102. In other embodiments, the crate 100 may include a retaining member 130 or latch 140 for each side of each wall 140. As one example, each wall 150A,B may include a retaining member 130 or latch 140 at the left side of the track that receives the wall 150A,B into the base 102 and a retaining member 130 or latch 140 at the right side of the track.

Figure 5A:
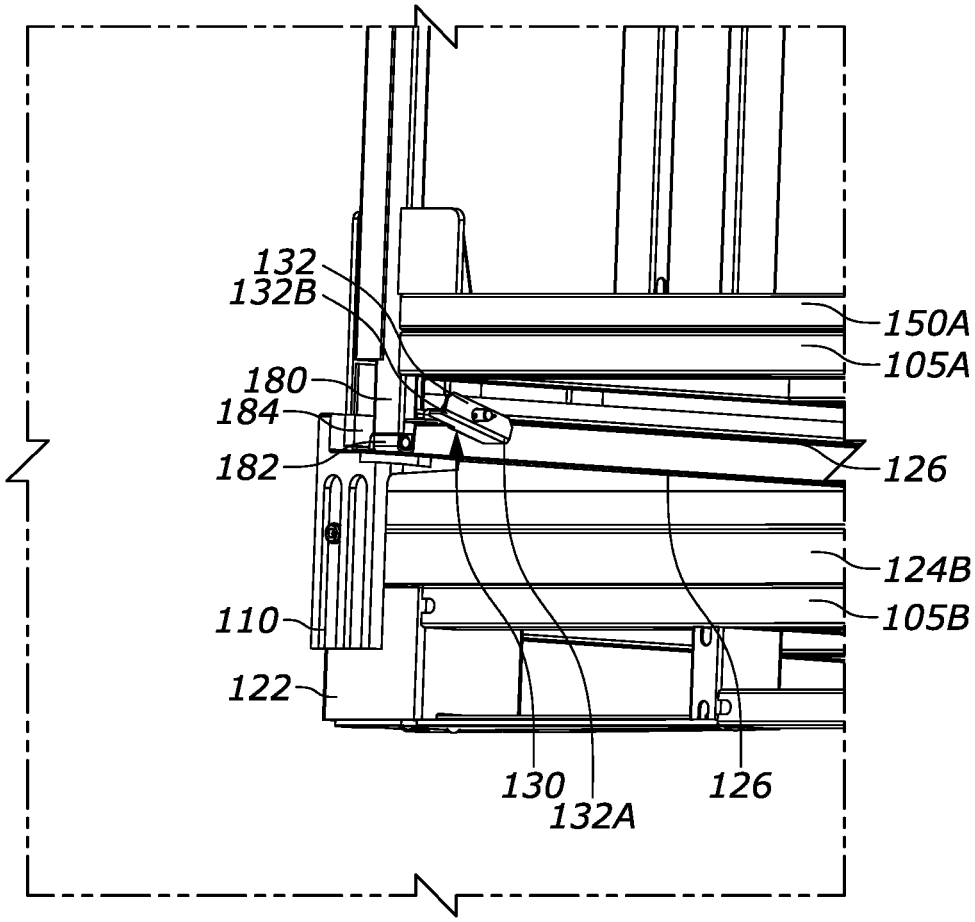
FIG. 5A is a front perspective view of a corner of the collapsible crate of FIG. 1A.
Figure 5B:
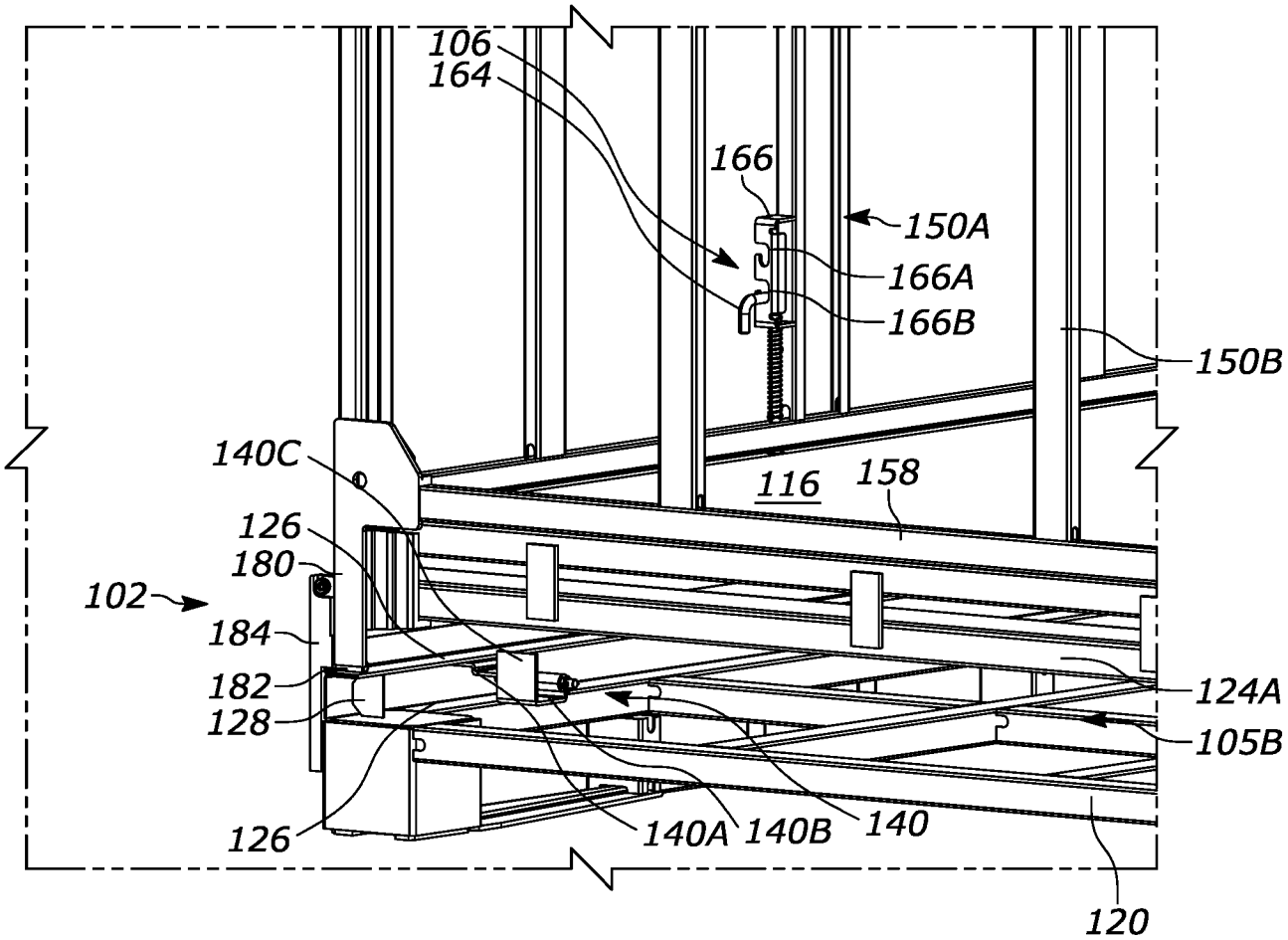
FIG. 5B is a right perspective view of a corner of the collapsible crate of FIG. 1A.
Figure 5C:
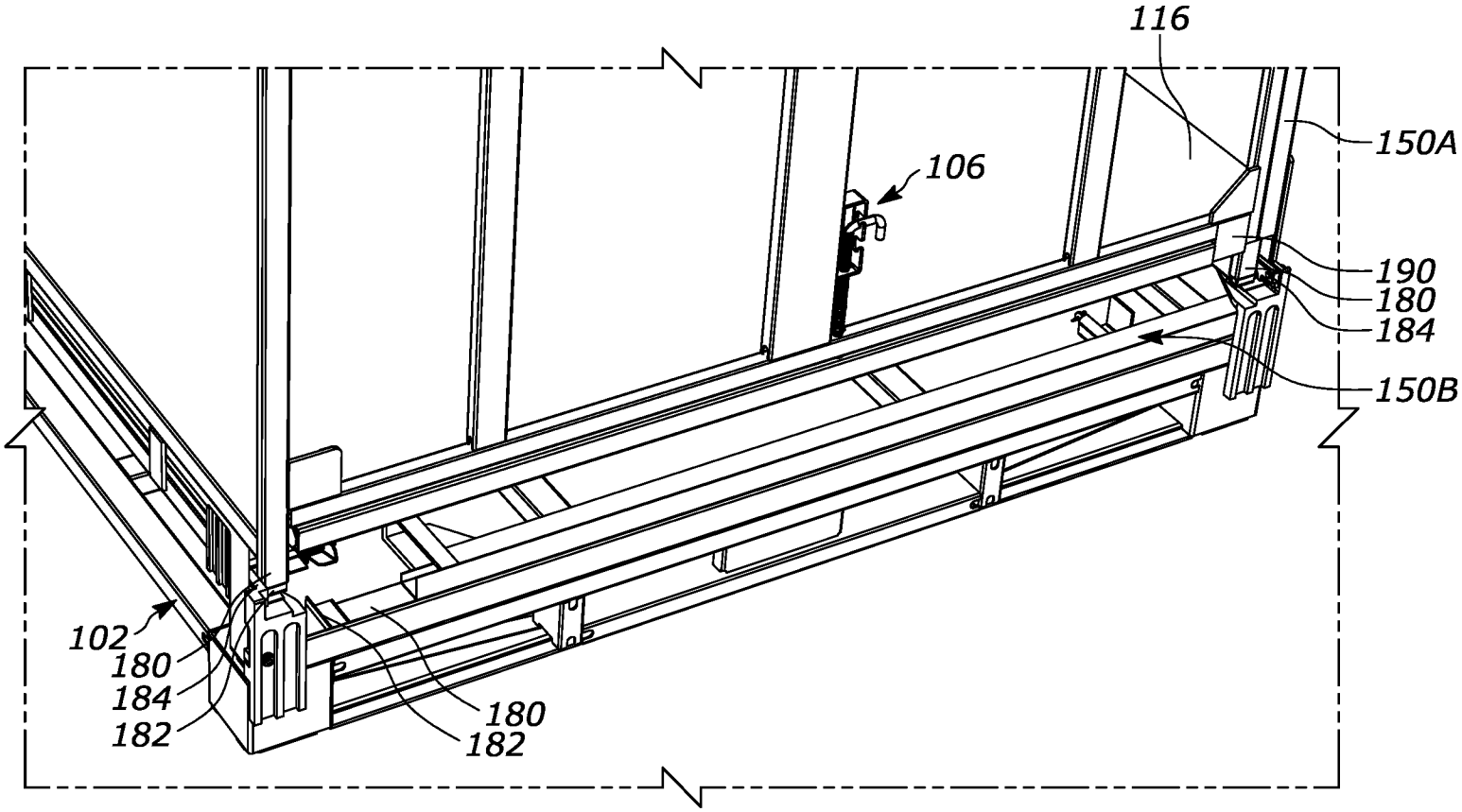
FIGS. 5C-D are perspective views of the lower portion of the collapsible crate of FIG. 1A in a partially collapsed configuration.
Figure 5D:
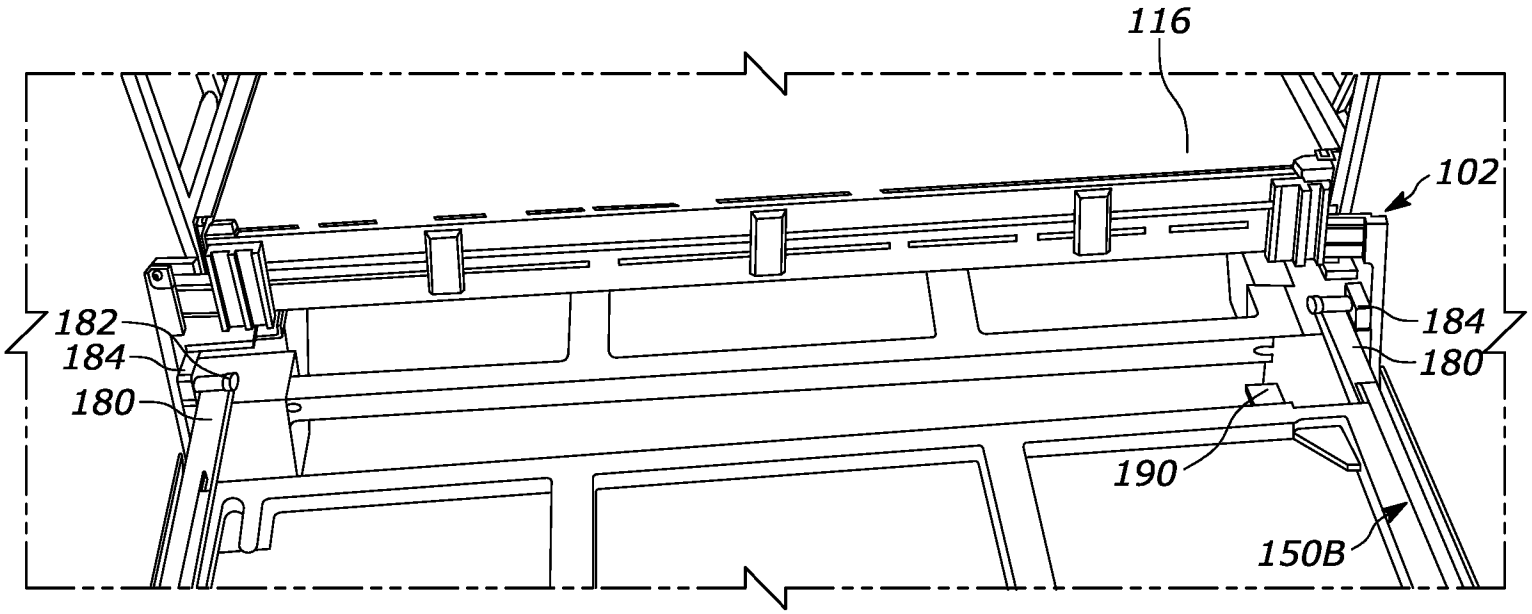
Figure 8A:
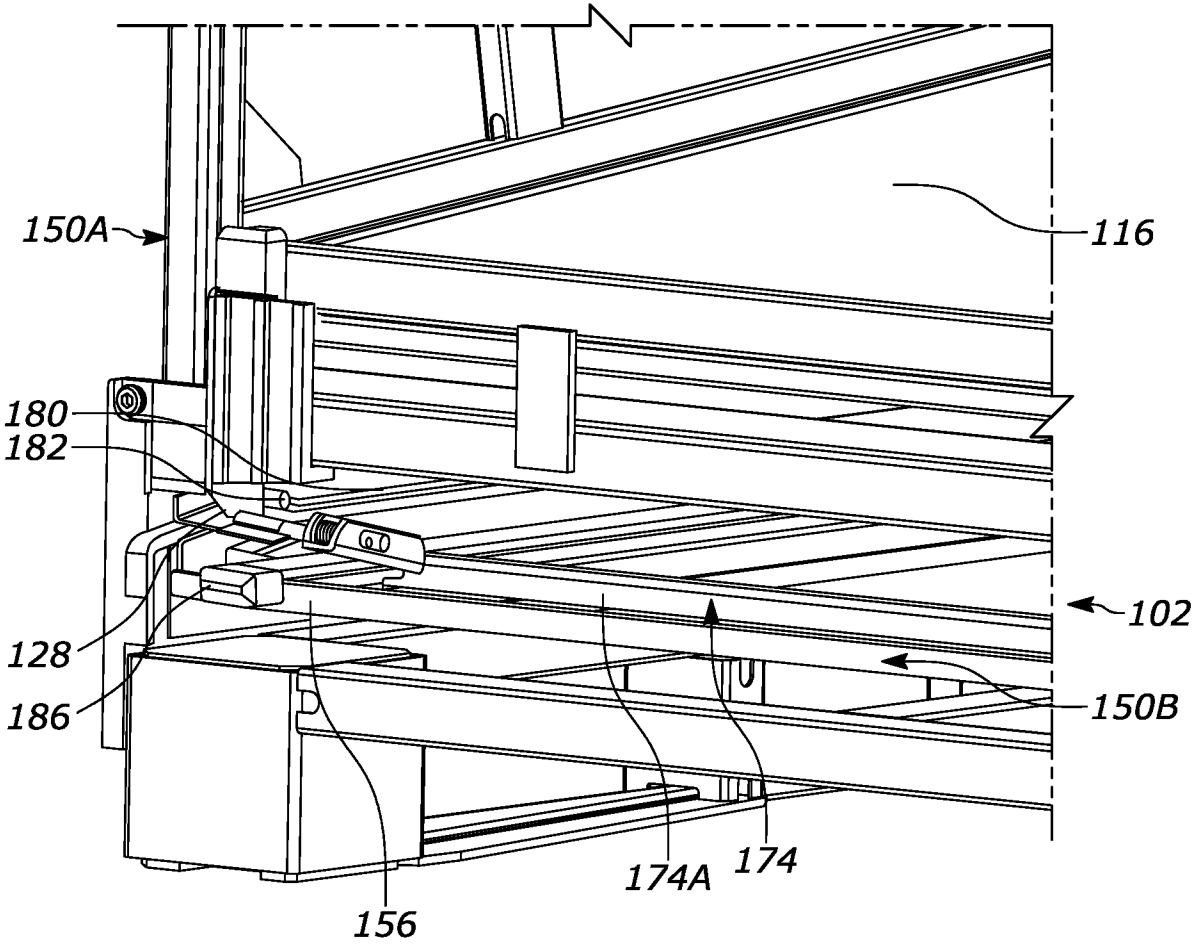
FIGS. 8A-B are top perspective views of corners of the collapsible crate of FIG. 1A shown with two walls inserted into the base of the collapsible crate.

With reference to FIGS. 5A and 8A, a retaining member 130 is shown extending from sidewall 124A. The retaining members 130 include a bar 132 that pivots about a shaft 134. The retaining members 130 include a torsion spring coupled to the shaft 134 and the bar 132 that biases and end 132A of the bar 132 downward and into the path of the track formed by two corresponding ledges 126. When a wall 150A,B is received within the cavity 112 of the base 102, the end 132A of the bar 132 extends downward and engages the top surface 174A of the crossbar 174 of the wall 150 (see FIG. 8A). The bar 132 of the retaining member 130 thus inhibits the wall 150A,B from exiting the cavity 112. To remove the wall 150A,B from the cavity, the end 132A of the bar 132 is rotated upward about the shaft 132. This may be done by depressing the end 132B opposite the end 132A to overcome the biasing force of the torsion spring. Once the bar 132 is no longer within the track and/or engaging the crossbar 174 of the wall 150A,B, the wall 150A,B may be withdrawn from the cavity 112.

Figure 7A:
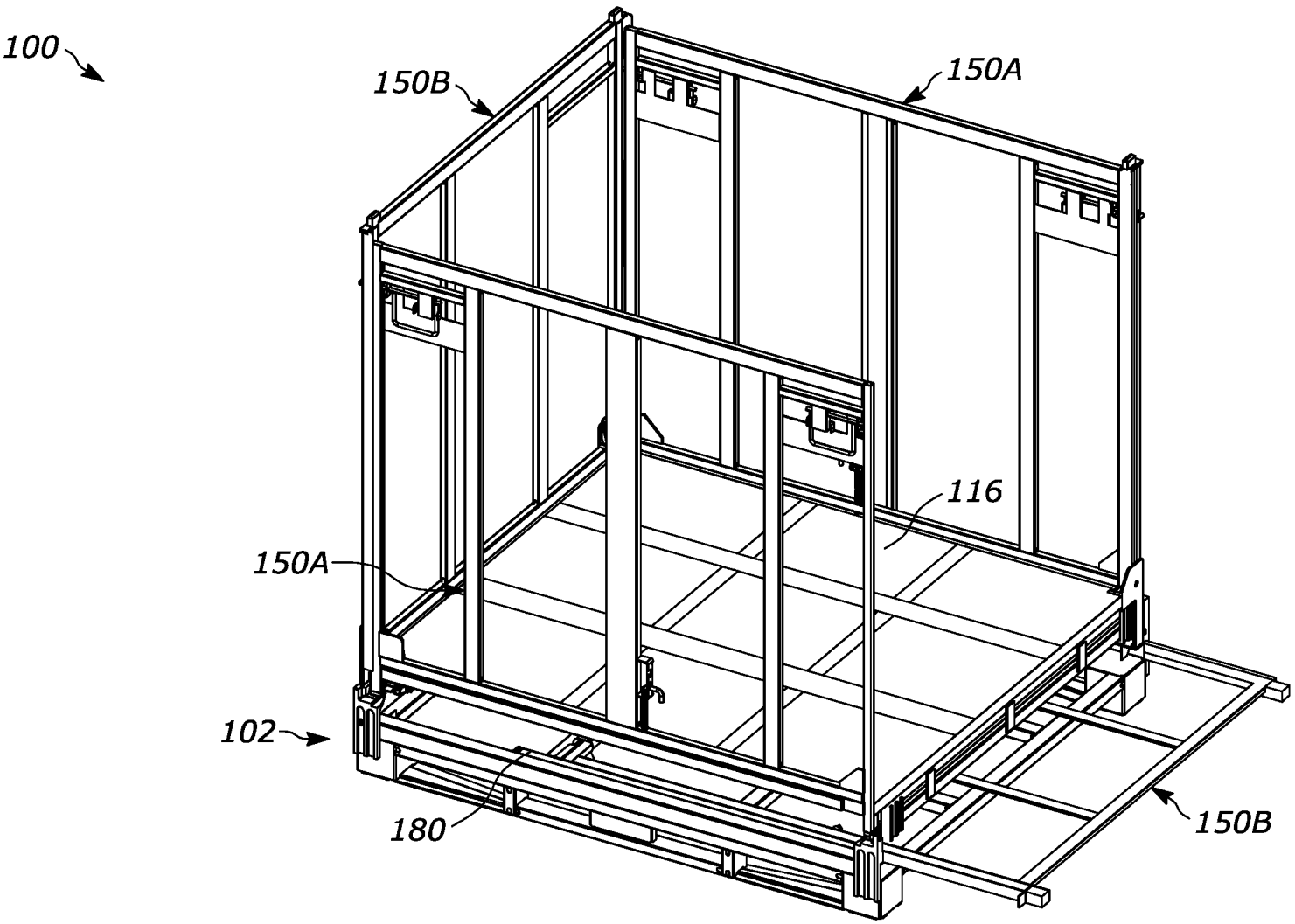
FIG. 7A is a top perspective view of the collapsible crate of FIG. 1A shown with a wall partially inserted into a base of the collapsible crate.
Figure 7B:
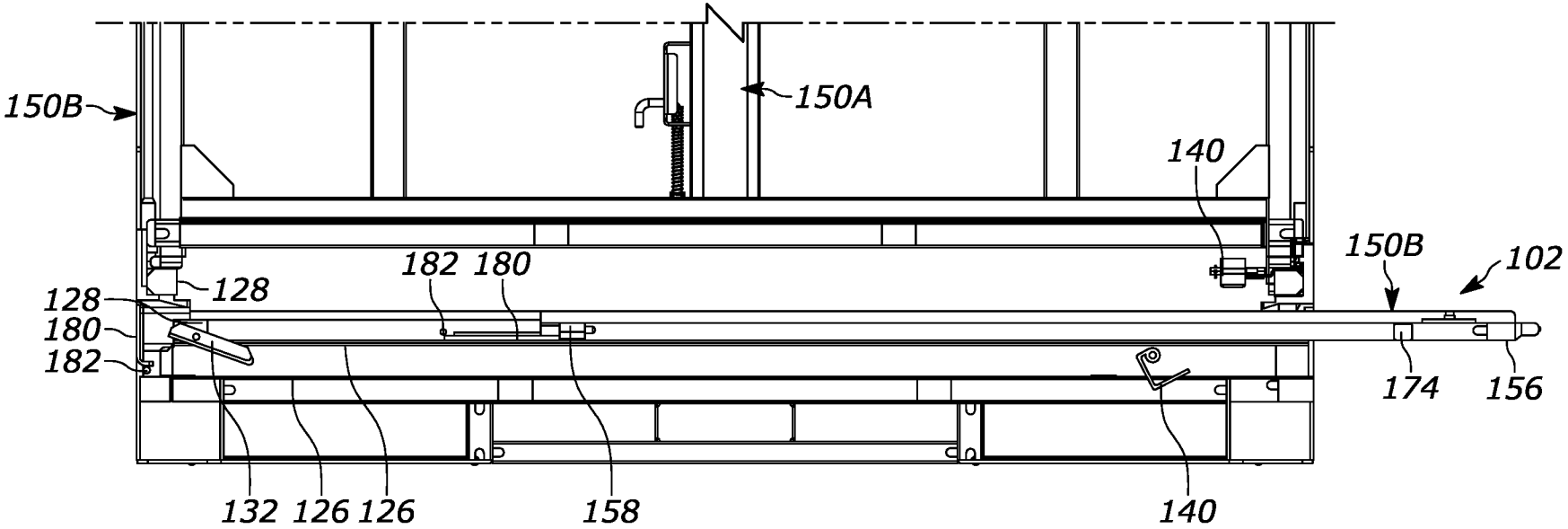
FIG. 7B is a right side cross-section view of the collapsible crate of FIG. 1A as shown in FIG. 7A.
Figure 7C:
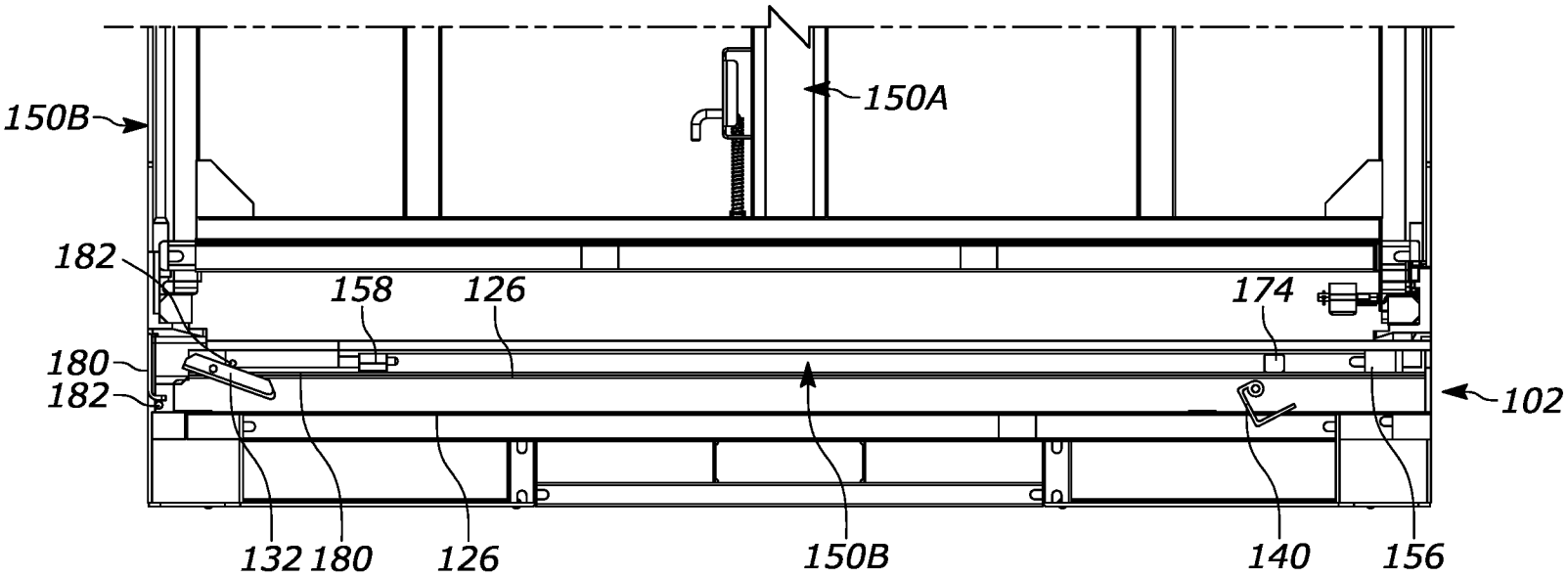
FIG. 7C is a right side cross-section view of the collapsible crate of FIG. 1A with a first wall fully inserted into the base of the collapsible crate.
Figure 7D:
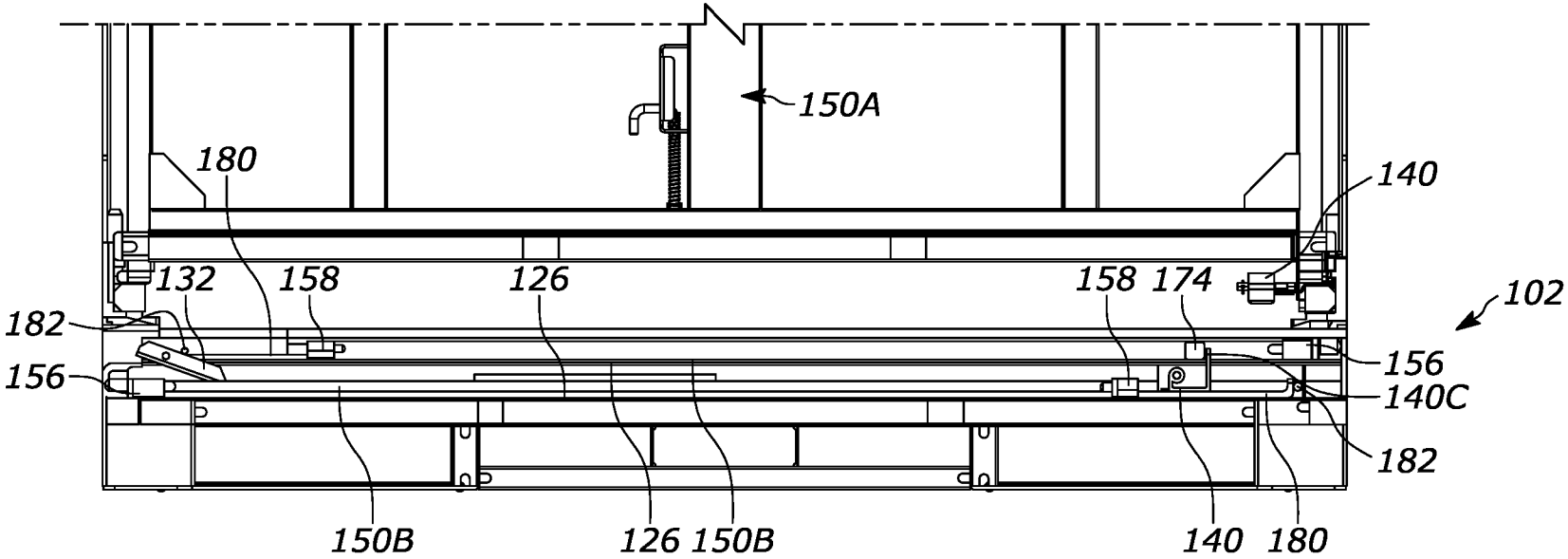
FIG. 7D is a right side cross-section view of the collapsible crate of FIG. 1A with two walls fully inserted into the base of the collapsible crate.
Figure 8B:
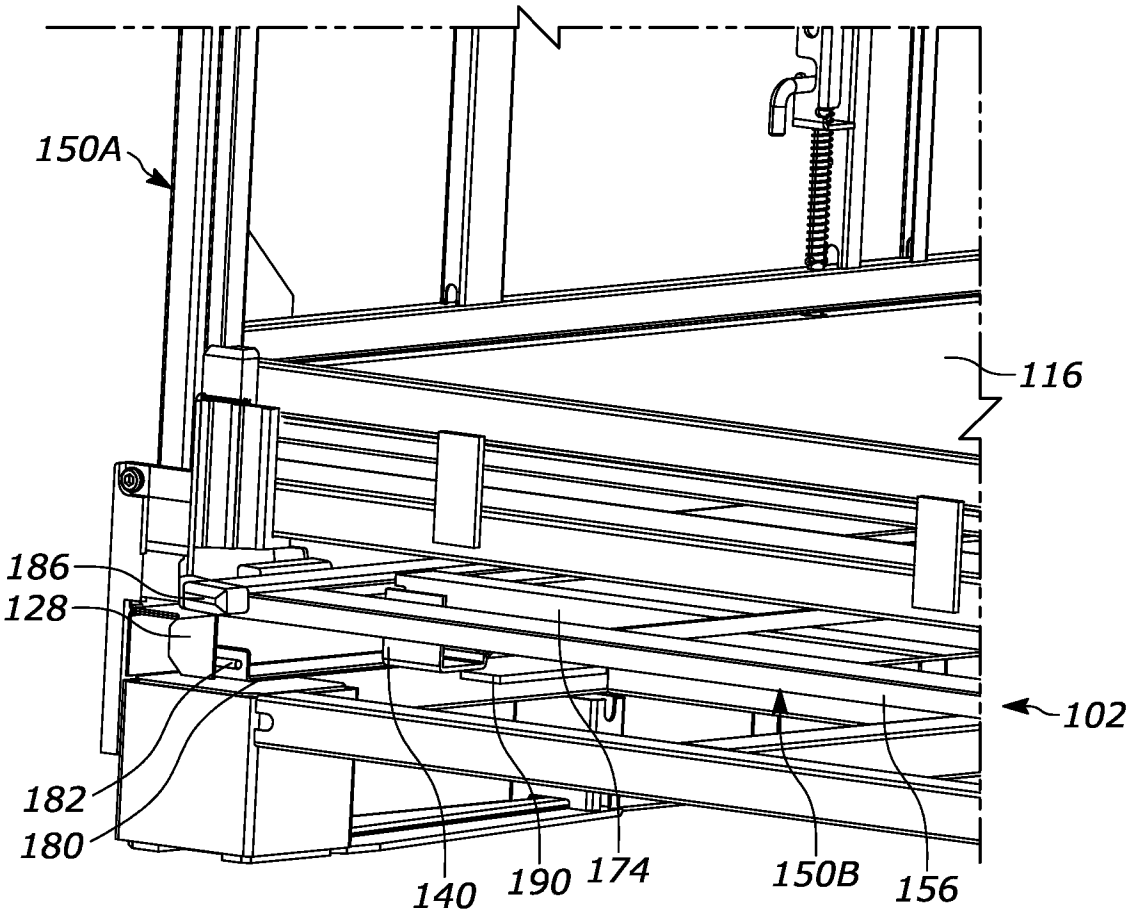

With reference to FIGS. 5B and 8B, a latch 140 is shown extending from a ledge 126. The latch 140 includes a support 140A extending from the sidewall 124B and a bracket 140B configured to rotate about the axis of the support 140A. As shown in FIGS. 5B and 8B, the latch 140 is in the retaining orientation to engage and/or retain a wall 150A,B along the associated track of the base 120. The bracket 140B includes a vertically extending member 140C that may be rotated to extend into the path of the track formed by two corresponding ledges 126. When two opposing walls 150A,B are within the cavity 112 when the crate 112 is in the collapsed configuration, the latch 140 is in the retaining orientation. When in the retaining orientation, the vertically extending member 140C of the latch 140 engages the top surface 174A of the crossbar 174 of the wall 150A,B to prevent the wall 150A,B from exiting the cavity 112 while sliding along the ledges 126 forming the track (see FIGS. 7D and 8B). The vertically extending member 140C thus acts as a stop that inhibits the wall 150A,B from unintentionally exiting the cavity 112. As shown in FIGS. 7A-C, the rotatable hooks 140 may be configured to pivot about the support 140A or hang in a non-retaining orientation such that the vertically extending member 140C is not within the path of a wall 150A,B enabling the wall 150A,B which the latch 140 retains to be slid into the cavity 112 of the base 102. Upon insertion of the opposing wall 150A,B into the cavity 112 of the base 102 along the track, the latch engaging member 190 engages the bracket 140B to rotate the bracket 140B about the axis of the support 140A to bring the vertically extending member 140C into the track of the wall 150A,B above the wall 150A,B with the latch engaging member 190 (i.e., the retaining orientation). In the embodiment shown, the latch engaging member 190 slides along the bottom side of the bracket 140B of the latch 140 which causes the bottom side of the bracket 140B to align with the latch engaging member 190, thereby rotating the latch 140 into the retaining orientation (see FIGS. 7D and 8B). With the vertically extending member 140C within the pathway of the wall 150A,B, the wall 150A,B is not able to slide out of the base 102 along its track. The vertically extending member 140C may engage the crossbar 174 of the wall 150A,B to inhibit the wall 150A,B from being inadvertently withdrawn from the base 102. When the opposing wall 150A,B is withdrawn from the base 102, the latch engaging member 190 no longer forces the latch 140 into the retaining orientation and the latch returns to the non-retaining orientation allowing the wall 150A,B to be withdrawn from the base 102.

With respect to FIGS. 5A-D, each of the walls 150A,B further includes legs 180 extending from the bottom member 158 that engage the ledges 126 of the base 102. The legs 180 of the walls 150A,B are sized such that when the wall 150A,B is in an upright position (e.g., when the crate is in an assembled configuration) the legs 180 extend to the corresponding ledges 126 of the base 102 that form the track for receiving the wall 150A,B within the cavity 112 of the base 102. Since the ledges 126 for each wall 150A,B are at a different distance from the bottom wall 116 of the base 102 (e.g., the tracks are at different levels), the legs 180 for each wall 150A,B are different lengths. For instance, the wall 150A,B that slides into the bottom track has the longest legs 180 since the legs 180 must extend from the bottom member 158 to the ledges 126 of the bottom track. The wall 150A,B that slides into the top track of the base 102 has the shortest legs 180 since the legs 180 only extend from the bottom member 158 of the wall 150A,B to the ledges 126 of the top track. The legs 180 each include a pin 182 disposed on the end of the legs 180 opposite the top of the wall 150. The pins 182 may include a rounded surface that aids in pivoting or rotating the walls 150A,B between horizontal and upright positions when assembling and collapsing the crate 100. The pins 182 extend laterally outward from the legs 180 and engage a stop 184 when the wall 150A,B is withdrawn from the cavity 112 of the base 102. The stop 184 prevents the wall 150A,B from being detached or disassociated from the base 102 when the wall 150A,B is withdrawn from the base 102 when assembling the crate 100. The stop 184 may include a top portion that extends over top of the pin 182 when the pin 182 is slide to the end of the track when the wall is withdrawn that prevents the pin 182 from being moved substantially upward off of the ledge 126 on which the pin 182 slides. When the wall 150A,B is withdrawn and the pins 182 engage the stop 184, the wall 150A,B may then be rotated to an upright position about the base 102.

In another embodiment, the walls 150A,B do not include legs 180 that extend to or remain in contact with the track corresponding to each wall 150A,B but instead, the walls 150A,B are detached and manually aligned for insertion into the track of the base 102 rather than pivoting the wall 150A,B about the legs 180 that rest on the ledges 126 forming the track.

As shown in FIGS. 1A-G, the connecting walls 150B include protrusions 186 extending from the top member 156. The support blocks 122 of the base 102 include complementary recesses 188 that are sized to receive the protrusions 186. These protrusions 186 and recesses 188 enable the crate 100 to be stacked on top of another crate 100 by positioning the protrusions 186 of a first crate 100 into the recesses 188 of a second crate 100.

Figure 6A:
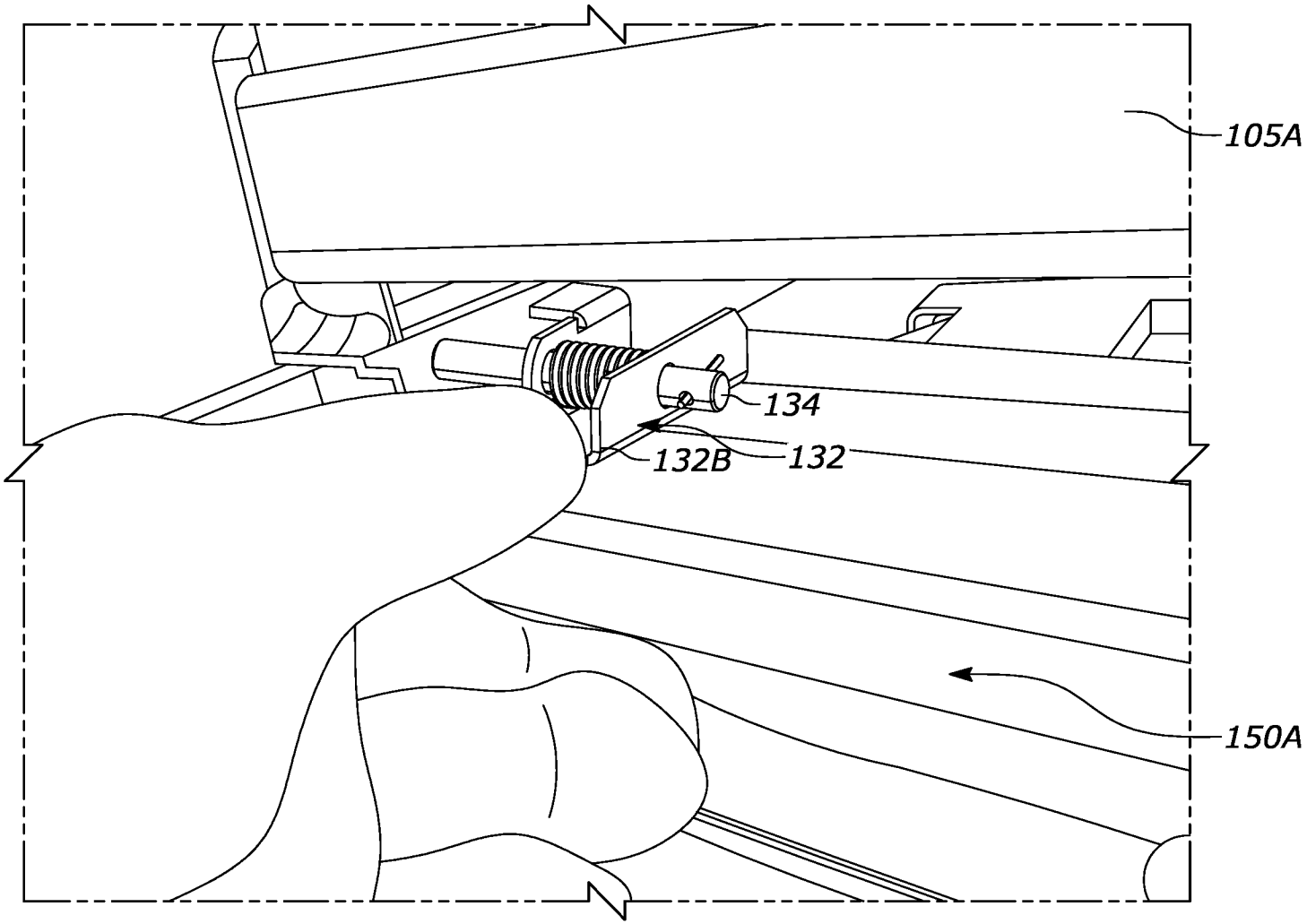
FIGS. 6A-G show figures of the process of assembling the collapsible crate of FIG. 1A.
Figure 6B:
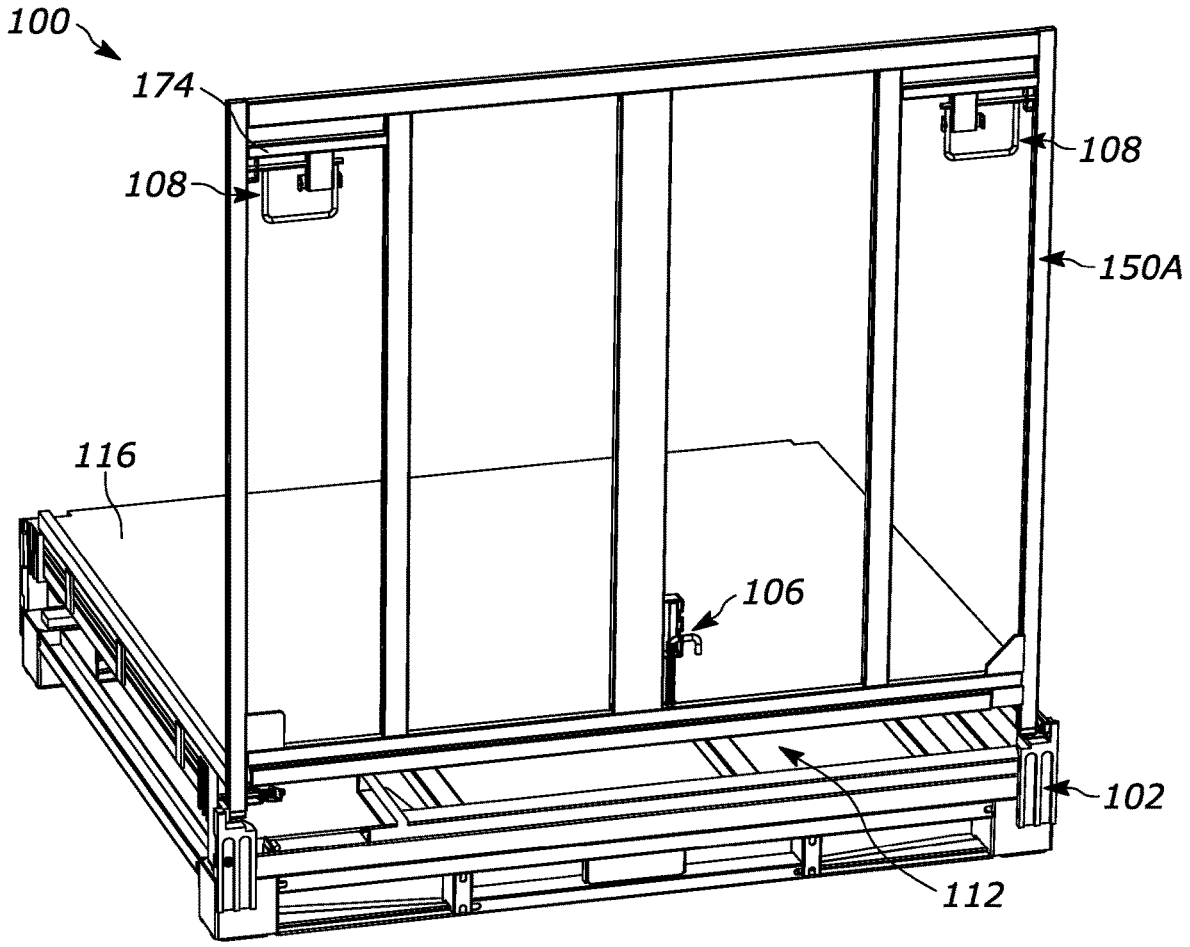

To assemble the crate 100 from the collapsed configuration shown in FIG. 2, the bar 132 of the retaining member 130 engaging the crossbar 174 of a locking wall 150A is rotated to move the end 132A of the bar 132 upward and out of the path of the track of the first locking wall 150A. As shown in FIG. 6A, this may be done by pressing downward on the end 132B. The locking wall 150A is slid along the ledges 126 of the track on which the locking wall 150A rests until the pins 182 of the legs 180 of the locking wall 150A engage the stops 184 of the base 102. With reference to FIG. 6B, the upper end of the locking wall 150A is then rotated toward an upright position about the pins 182 until the bottom member 158 rests on the bottom wall 116 of base 102. The handle portion 164A of the locking pin 164 of the wall orientation locking mechanism 106 is then rotated outward from the upper notch 166A of the U-shaped bracket 162. The locking pin 164 is then forced downward toward the base 102 to extend the shaft 164B of the locking pin 164 through the hole 158A of the bottom member 158 and into the hole 118 of the bottom wall 116. With reference again to FIG. 4A, the handle portion 164A of the locking pin 164 is then rotated toward the U-shaped bracket 162 until the handle portion 164A of the locking pin 164 is within the lower notch 166B of the U-shaped bracket 162, thereby locking the locking wall 150A into an upright position.

Figure 6C:
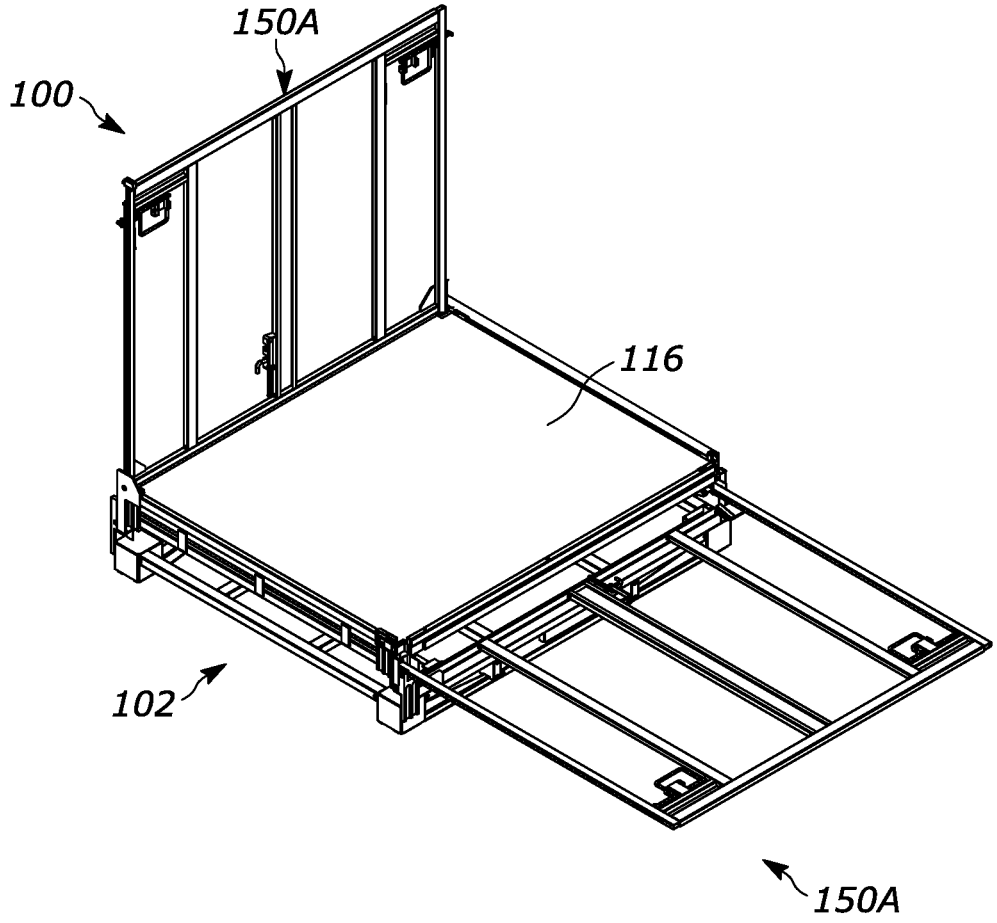

The second locking wall 150A on the opposite side of the crate 100 of the first locking wall 150A is then removed from the base 102 as shown in FIG. 6C. Upon removal of the first locking wall 150A, the latch 140 pivots to the non-retaining orientation where the vertically extending member 140C is not within the path of the track of the second locking wall 150A (similar to that shown with respect to the connecting walls 150B in FIGS. 7B-C). The second locking wall 150A is slid outward from the base 102 along the ledges 126 of the track on which the locking wall 150A rests. The locking wall 150A is slid outward from the base 102 along the ledges 126 until the pins 182 of the legs 180 of the locking wall 150A engages the stops 184 of the base 102. The locking wall 150A is then pivoted toward an upright position and locked using the wall orientation locking mechanism 106 similar to the first locking wall 150A.

Figure 6D:
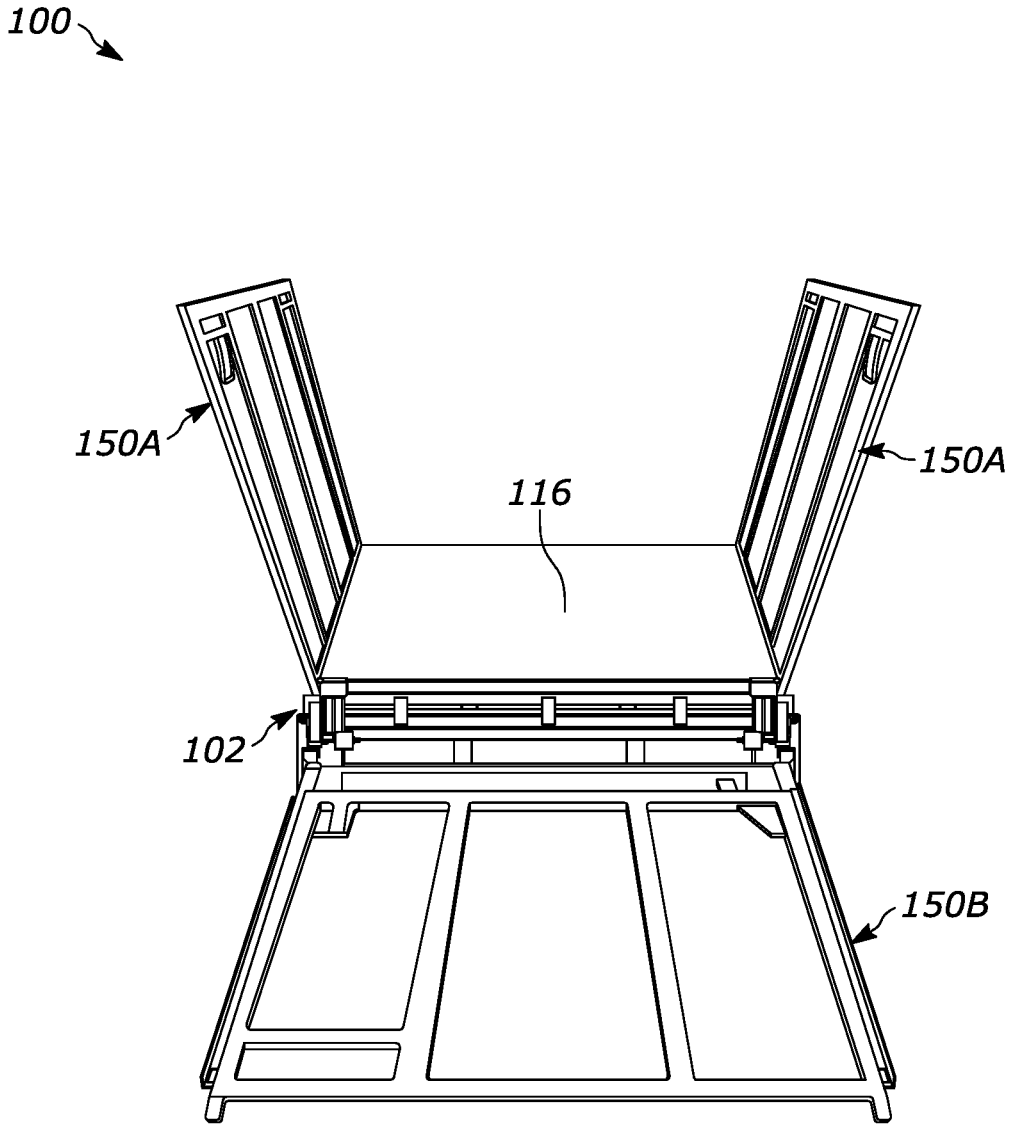

As shown in FIG. 6D, the first connecting wall 150B is removed from the base 102. To do this, the retaining member 130 may be disengaged from the crossbar 174 of the connecting wall 150B as described above. The wall 150B may then be withdrawn from the base 102 until the pins 182 of the legs 180 of the first connecting wall 150B engage the stops 184 of the base 102. The first connecting wall 150B is then pivoted to an upright position with the bottom member 158 resting on the bottom wall 116 of the base 102 and the slots 159B aligned with the slots 159A of the adjacent locking walls 150A.

Figure 6E:
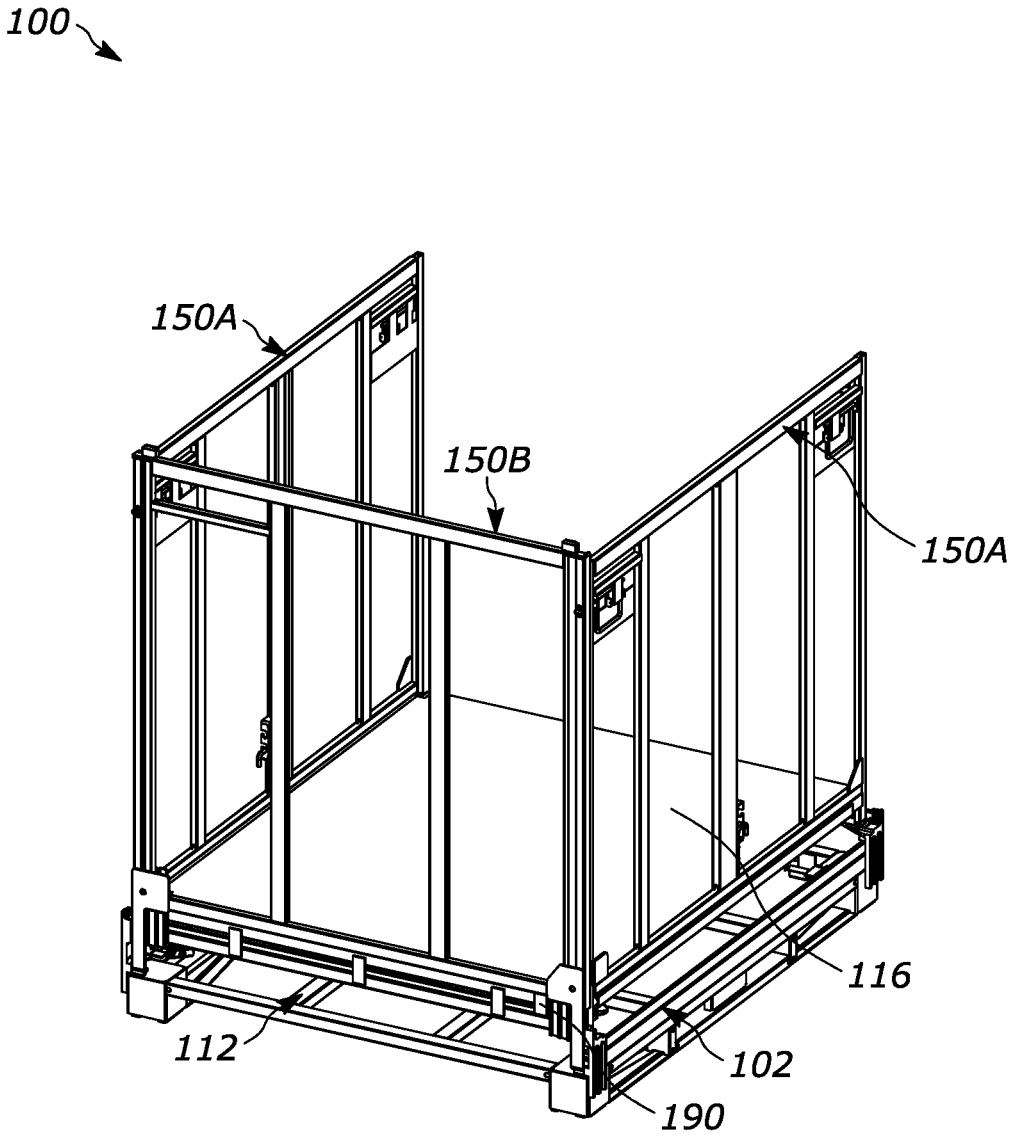

The handle portion 172A of the locking pin 172 of the wall locking mechanism 108 of a locking wall 150A is then rotated upward to align the hook portion 172C of the locking pin 172 with the slots 159A,B. The locking pin 172 is then slid along the axis of the shaft of the locking pin 172 to pass the hook portion 172C through the slots 159A,B. The handle portion 172A is then rotated downward to misalign the hook portion 172C and the slots 159A,B. The handle portion 172A is forced in between a retaining arm 171A of the handle retaining bracket 171 and the supporting bracket 172 to lock the handle portion 172A in the locked configuration, thereby locking the locking wall 150A to the connecting wall 150B. The other locking wall 150A is similarly connected to the first connecting wall 150B using the wall locking mechanism 108. As shown in FIG. 6E, three walls of the crate 100 are then assembled in an upright position.

Figure 6F:
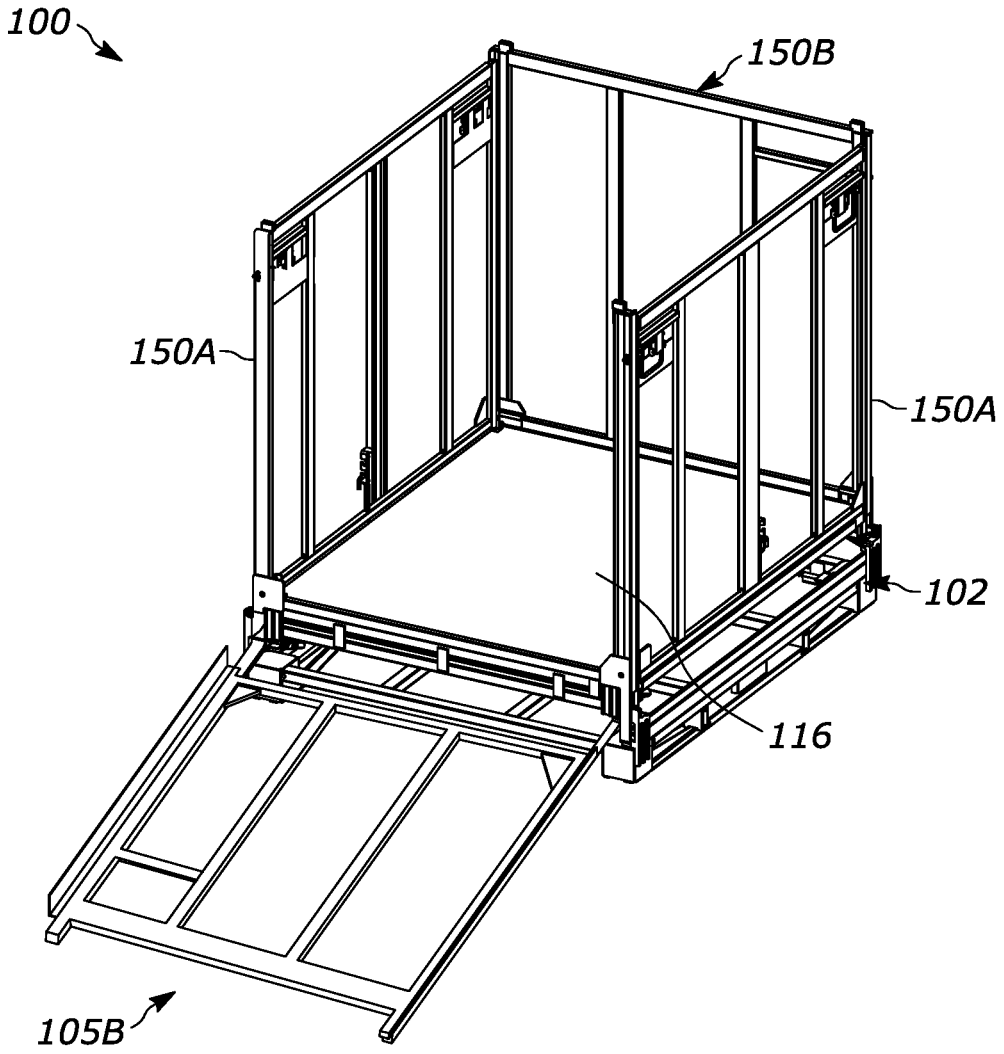
Figure 6G:
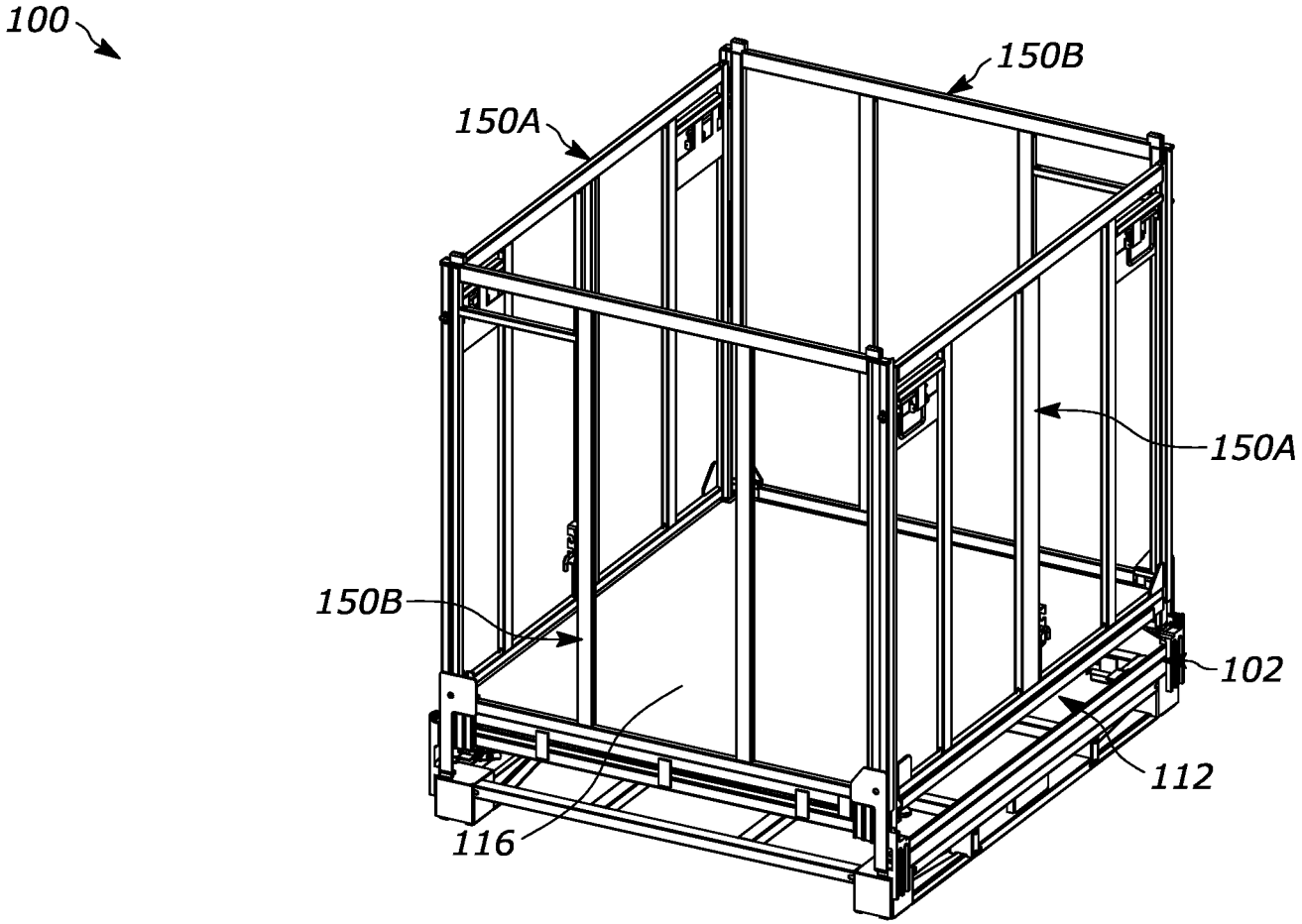

The second connecting wall 150B opposite the first connecting wall 150B is then withdrawn from the base 102. As shown in FIGS. 7B-7C, when the first connecting wall 150B is withdrawn from the base 102, the latch 140 is in the non-retaining orientation and not inhibiting movement of the second wall 150B out of the base 102. The second connecting wall 150B is slid outward from the base 102 along the ledges 126 of the track on which the second connecting wall 150B rests. The second connecting wall 150B is slid outward from the base 102 along the ledges 126 until the pins 182 of the legs 180 of the second connecting wall 150B engage the stops 184 of the base 102 as shown in FIG. 6F. The connecting wall 150B is then pivoted about the pins 182 toward an upright position similar to the first connecting wall 150B. The wall locking mechanisms 108 are similarly used as described in regard to the first connecting wall 150B to secure the connecting wall 150B to the adjacent locking walls 150A. The crate 100 is then in an assembled configuration as shown in FIG. 6G.

To collapse the crate 100, the steps of assembling the crate 100 are performed in the reverse order. The second connecting wall 150B is disconnected from the adjacent locking walls 150A by moving the wall locking mechanisms 108 to the unlocked configuration to bring the hook portion 172C of the locking pin 172 into alignment with the slots 159A,B. The locking pin 172 is then slid along the axis of the shaft portion 172B to the disconnected configuration to withdraw the locking pin 172 from the slots 159A,B. The locking pin 172 may then be rotated to the locked configuration to attach the locking pin 172 to the handle retaining bracket 171 to prevent the handle portion 172A from unintentional rotation about the shaft portion 172B of the locking pin 172. The second connecting wall 150B is then disconnected from the adjacent locking walls 150A and the upper portion of the connecting wall 150B may be rotated about the pins 182 of the legs 180 until the second connecting wall 150B is substantially aligned with the track of the base 102 formed by the ledges 126 of the sidewalls 124B. The connecting wall 150B may then be slid into the cavity 112 of the base 102 along the ledges 126. The connecting wall 150B may be inserted until the legs 180 abut the stops 128 on the ledges 126.

The first connecting wall 150B may be disconnected from the adjacent locking walls 150A similarly to steps described in regard to the second connecting wall 150B above. The first connecting wall 150B may be rotated about the pins 182 of the legs 180 until the connecting wall 150B is substantially aligned with the track of the base 102 formed by the ledges 126 of the sidewalls 124B. The first connecting wall 150B may then be slid into the cavity 112 of the base 102 along the ledges 126. The crossbar 174 may be brought into contact with the retaining member 130 causing the end 132A of the retaining member 130 to deflect upward to allow the wall 150B to enter the cavity 112. Once the crossbar 174 passes under the retaining member 130, the retaining member 130 springs into the path of the connecting wall 150B along the track, preventing the wall 150B from unintentional removal from the cavity 112 of the base 102. As the first connecting wall 150B is inserted along the track, the latch engaging member 190 contacts the latch 140 of the second connecting wall 150B and rotates the latch 140 into the retaining orientation. The vertically extending member 140C of the latch '140 then extends into the path of the track of the second connecting wall 150B and may contact the crossbar 174 of the second connecting wall 150B to inhibit the second connecting wall 150B from sliding out of the base 102 (as shown in FIG. 7D). The connecting wall 150B may be slid along the ledges 126 until the legs 180 abut the stops 128 on the ledges 126.

The locking pin 164 of the wall orientation locking mechanism 106 of the second locking wall 150A may then be withdrawn from the hole 118 of the bottom wall 116 and moved to the unlocked configuration with the handle portion 164A within the upper notch 166A of the U-shaped bracket 162. The second locking wall may then be rotated about the legs 180 and inserted into the cavity 112 of the base 112 along the track formed by the ledges 126 along the sidewalls 124A similar to process described above in regard to the second connecting wall 150B.

The first locking wall 150A may then be disconnected from base 102 similar to the process described above in regard to the second locking wall 150A. The first locking wall 150A may then be rotated about the legs 180 and inserted into the cavity 112 of the base 112 along the track formed by the ledges 126 along the sidewalls 124A similar to process described in regard to the first connecting wall 150B. With all four walls 150A,B within the cavity 112 of the base 102, the crate 100 is in the collapsed configuration as shown in FIG. 2.

Uses of singular terms such as "a," "an," are intended to cover both the singular and the plural, unless otherwise indicated herein or clearly contradicted by context. The terms "comprising," "having," "including," and "containing" are to be construed as open-ended terms. It is intended that the phrase "at least one of" as used herein be interpreted in the disjunctive sense. For example, the phrase "at least one of A and B" is intended to encompass only A, only B, or both A and B.

While there have been illustrated and described particular embodiments of the present invention, those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

What is claimed is:

1. A collapsible crate comprising:

a base including a top surface and defining a cavity below the top surface; and a plurality of walls removably attachable to one another and movable between a first configuration where the plurality of walls extend substantially vertically above the top surface of the base and a second configuration where the plurality of walls are within the cavity of the base.

2. The collapsible crate of claim 1 wherein the base includes a plurality of tracks within the cavity, each track of the plurality of tracks configured to receive a wall of the plurality of walls and guide the wall as the wall is slid into or out of the cavity.

3. The collapsible crate of claim 2 wherein each track of the plurality of tracks is substantially parallel to the top surface of the base and at a different vertical position relative to the other tracks of the plurality.

4. The collapsible crate of claim 2 wherein each track of the plurality of tracks is comprised of a first portion for receiving a first side of a wall of the plurality of walls and a second portion for receiving a second side of the wall.

5. The collapsible crate of claim 1 wherein each wall of the plurality of walls includes an attachment arm that engages the base about which the wall is rotatable when detached from the other walls of the plurality of walls.

6. The collapsible crate of claim 5 wherein the attachment arm includes a rounded end that engages a track of the base about which the wall rotates.

7. The collapsible crate of claim 1 wherein a first wall of the plurality of walls includes a locking mechanism for locking the first wall to a second wall of the plurality, the locking mechanism having a pin that extends into a complementary hole of the second wall to attach the first wall to the second wall.

8. The collapsible crate of claim 1 wherein a first wall of the plurality of walls includes a locking mechanism for locking the first wall in a position substantially perpendicular to the top surface of the base, the locking mechanism including a pin configured to extend into a complementary hole of the base to prevent the first wall from substantial rotation relative to the base.

9. The collapsible crate of claim 1 wherein the top surface of the base is configured to support items thereon when the crate is in the first and second configurations and when all walls of the crate are positioned within the cavity of the base.

10. The collapsible crate of claim 1 wherein the base includes a lower frame below the cavity, the lower frame spaced apart from a surface on which the base rests permitting forks of moving equipment to be extended below the lower frame to transport the crate.

11. A collapsible crate comprising:

a base including a top surface and defining a cavity below the top surface, the base including a first track within the cavity for receiving a first wall at a first vertical position and a second track within the cavity for receiving a second wall at a second vertical position different from the first vertical position;

the first wall comprising an upper portion extending from the top surface of the base in an assembled configuration, the first wall comprising an attachment arm extending from the upper portion to engage the first track of the base in the assembled configuration, the first wall being rotatable relative to the base about the attachment arm to align the first wall with the first track to slidingly insert the first wall into the cavity of the base along the first track to move the first wall to a collapsed configuration;

the second wall comprising an upper portion extending from the top surface of the base in an assembled configuration, the second wall insertable into the cavity of the base along the second track to move the second wall to a collapsed configuration.

12. The collapsible crate of claim 11 further comprising a retaining mechanism attached to the base and configured to retain the first wall within the base when the first wall is in the collapsed configuration.

13. The collapsible crate of claim 12 wherein the retaining mechanism includes a retaining bar configured to engage a portion of the first wall when the first wall is inserted into the cavity to secure the first wall within the base in the collapsed configuration.

14. The collapsible crate of claim 13 wherein the retaining bar is configured to contact a crossbar of the first wall.

15. The collapsible crate of claim 13 wherein the retaining bar is affixed to the base via a torsion spring and biased toward a position that engages the portion of the first wall when the first wall is within the cavity of the base.

16. The collapsible crate of claim 13 wherein the retaining bar extends at an angle relative to the first track such that the retaining bar is deflected by the first wall as the first wall is inserted into the base and springs back to engage the portion of the first wall when the first wall is fully inserted into the cavity of the base.

17. The collapsible crate of claim 12 wherein the retention mechanism includes a rotatable latch configured to be rotated to a retaining orientation to secure the first wall within the base upon insertion of the second wall into the base along the second track of the base.

18. The collapsible crate of claim 17 wherein a portion of the second wall engages the rotatable latch as the second wall is inserted into the base along the second track causing the rotatable latch to rotate to the retaining orientation where a portion of the rotatable latch extends within the pathway of the first wall along the first track thereby securing the first wall within the base.

19. The collapsible crate of claim 17 further comprising a second retention mechanism configured to retain the second wall within the base when the second wall is inserted into the base along the second track.

20. The collapsible crate of claim 11 wherein the upper portion of the first wall includes a first and second side configured to engage the first track upon insertion into the cavity of the base.

21. The collapsible crate of claim 11 wherein the first track includes a first flat plate mounted along a first side of the base and a second flat plate mounted along a second side of the base, the first flat plate for engaging the first side of the first wall upon insertion into the base and the second flat plate for engaging the second side of the first wall upon insertion into the base.

22. The collapsible crate of claim 21 wherein the attachment arm slidingly engages the first flat plate.

23. The collapsible crate of claim 11 wherein the first track includes a first stop against which the attachment arm of the first wall abuts when the first wall is inserted into the cavity of the base and a second stop against which the attachment arm of the first wall abuts when the first wall is withdrawn from the cavity of the base.

24. The collapsible crate of claim 11 wherein the first wall includes a locking mechanism including a pin configured to be extended into a complementary hole of the base for locking the first wall to the base such that the wall extends upward from the base, the locking mechanism inhibiting substantial rotation of the first wall relative to the base in the assembled configuration.

25. The collapsible crate of claim 11 wherein the first wall includes a locking mechanism including a pin configured to be extended into a complementary hole of a second wall for locking the first wall to the second wall in the assembled configuration.

26. The collapsible crate of claim 11 wherein the first wall includes a hole for receiving a pin of a locking mechanism of a second wall to lock the first wall to the second wall in the assembled configuration.

27. A method of collapsing a crate comprising:

detaching a first wall of a crate from a second wall of the crate, the crate including a base having a top surface and defining a cavity below the top surface;

rotating an upper end of the first wall outward from the crate to a position substantially parallel with the top surface of the base;

sliding the first wall inward and into the cavity of the base;

rotating an upper end of the second wall outward from the crate to a position substantially parallel with the top surface of the base; and sliding the second wall of the crate inward and into the cavity of the base.

28. A method of assembling a collapsible crate comprising:

withdrawing a first wall of a crate from a cavity, the crate including a base having a top surface and defining the cavity below the top surface;

rotating an upper end of the first wall upward to an upright position;

locking the first wall in the upright position;

withdrawing a second wall of the crate from the cavity;

rotating an upper end of the second wall to an upright position;

withdrawing a third wall of the crate from the cavity;

rotating an upper end of the third wall to an upright position; and locking the first wall in the upright position.

* * * * *